US005506482A

United States Patent [19]

Teramatsu et al.

[11] Patent Number: 5,506,482

[45] Date of Patent: Apr. 9, 1996

[54] MAGNETIC FOCUSING SYSTEM WITH IMPROVED SYMMETRY AND MANUFACTURABILITY

[75] Inventors: Shigenori Teramatsu; Hiroshi Sasaki, both of Nagaokakyo, Japan

[73] Assignee: Mitsubishi Denki Kabushiki Kaisha, Tokyo, Japan

[21] Appl. No.: 280,927

[22] Filed: Jul. 26, 1994

[30] Foreign Application Priority Data

Aug. 5, 1993 [JP] Japan ..... 5-194765
Nov. 4, 1993 [JP] Japan ..... 5-275094

[51] Int. Cl.[6] ..... G09G 1/04; H01J 29/46; H01F 7/00; H01F 3/12

[52] U.S. Cl. ..... 315/382; 313/442; 335/210; 335/211

[58] Field of Search ..... 315/382, 535; 313/442; 335/210, 211

[56] References Cited

U.S. PATENT DOCUMENTS

| | | | |
|---|---|---|---|
| 2,822,528 | 2/1958 | Janssen et al. | 336/110 |
| 3,681,651 | 8/1972 | Schlesinger | 335/210 |
| 4,345,183 | 8/1982 | Fukuda | 313/412 |
| 4,490,644 | 12/1984 | Shimona | 313/413 |
| 4,668,893 | 5/1987 | Amboss | 315/3.5 |
| 5,113,162 | 5/1992 | Umehara et al. | 335/210 |

FOREIGN PATENT DOCUMENTS

| | | |
|---|---|---|
| 562567 | 6/1979 | Japan . |
| 57-82949 | 5/1982 | Japan . |
| 61-171040 | 8/1986 | Japan . |
| 1256883 | 10/1989 | Japan . |
| 1274344 | 11/1989 | Japan . |
| 220174 | 1/1990 | Japan . |
| 260035 | 2/1990 | Japan . |

OTHER PUBLICATIONS

Ohara, Hai–Bujon Gijutsu (High–Vision Technology), Ohm, 1992.

Terebijon Gazo Joho Kogaku Handobukku (Television Picture Information Engineering Handbook), Institute of Television Engineers of Japan, 1992.

*Primary Examiner*—Gregory C. Issing

[57] ABSTRACT

A magnetic focusing system has a pair of disc-shaped pole pieces between which several permanent rod magnets are mounted, their north poles in contact with one pole piece and their south poles in contact with the other pole piece. The permanent rod magnets are equally spaced around the outer perimeters of the pole pieces, and are separated from one another so that they do not create a ring. The pole pieces have central holes, between the rims of which a symmetric magnetic lens is formed for focusing an electron beam.

32 Claims, 20 Drawing Sheets

MAGNETIC FOCUSING SYSTEM WITH IMPROVED SYMMETRY AND MANUFACTURABILITY

BACKGROUND OF THE INVENTION

The present invention relates to a magnetic focusing system that uses permanent magnets to focus an electron beam in, for example, a cathode-ray tube.

Both magnetic and electrostatic focusing systems have been employed in cathode-ray tubes (hereinafter referred to as CRTs). Although magnetic systems are more costly than electrostatic systems, when a sharp, bright image is required, as in a projection television set, magnetic Focusing is preferable because of its superior focusing characteristics, and because it is less sensitive to the effects of increased cathode voltage. Hybrid systems comprising an electrostatic prefocusing system and a magnetic main Focusing system have also been used to improve the brightness and definition of both conventional color television and projection television sets.

FIG. 1A shows a frontal view of a conventional magnetic focusing system employing a cast alnico permanent ring magnet 1. FIG. 1B shows a sectional view through line b—b in FIG. 1A. The permanent ring magnet 1 is held between soft iron pole pieces 2*a* and 2*b*, which have respective central holes 2*c* to admit the neck of a CRT. The system is centered on a line that will be referred to as the z-axis. The permanent ring magnet 1 is magnetized parallel to the z-axis, its north pole being in contact with pole piece 2*a* and its south pole in contact with pole piece 2*b*. The system also includes a correcting coil 3 and dynamic focusing coil 4, which are wound on a hollow bobbin 5, the inner tubular surface of which is flush with the rims of the central holes 2*c*.

FIG. 2 illustrates the operation of this magnetic focusing system. The system is placed around the neck 6*a* of a CRT 6 having a cathode 7 that emits an electron beam 8. Lines of magnetic flux 9 generated by the permanent ring magnet 1 extend from the inside rim of pole piece 2*a* to the inside rim of pole piece 2*b*, forming a magnetic lens. An interaction between the beam 8 and magnetic flux 9, which will be described in more detail later, focuses the beam 8 to a spot. A direct current applied to correcting coil 3 adjusts the magnetic flux density so that, when beam 8 is directed down the z-axis, the focused spot falls on the center of the faceplate 6*b* of the CRT 6, as shown. The beam 8 can be deflected for vertical and horizontal scanning by a deflection yoke 10.

Without further correction, when deflected for scanning, the beam 8 would reach focus on an imaginary spherical surface indicated by the dashed line in FIG. 2, resulting in considerable defocusing of the beam spot on the nearly-flat faceplate 6*b*. Defocusing would be particularly noticeable at the edges of the screen. The necessary correction is supplied by alternating currents fed to the correcting coil 3 and dynamic focusing coil 4 in synchronization with the vertical and horizontal scanning produced by the deflection yoke 10, a process referred to as dynamic focusing.

FIG. 3 shows circuits typically employed to supply these alternating currents. A voltage waveform synchronized to the horizontal scanning frequency is input at a terminal 11 and passed through a phase corrector 12 to a voltage-to-current converter 13, which feeds current to the dynamic Focusing coil 4. This corrects the defocusing caused by horizontal scanning. A voltage waveform synchronized to the vertical scanning Frequency is input at another terminal 14 and passed through a phase corrector 15 to a voltage-to-current converter 16, which feeds current to the correcting coil 3 to correct the defocusing caused by vertical scanning. This current is superimposed on the direct current applied to the correcting coil 3 to maintain correct focus at the center of the screen.

FIG. 4 shows the flux density distribution of the magnetic lens. The horizontal axis in FIG. 4 is the z-axis, with magnetic flux density B indicated on the vertical axis. The flux density distribution is symmetric about the z-axis, and is maximal in the plane through the center of the permanent ring magnet 1.

The theory of magnetic lenses is well known and has been described, for example, in the book Theory and Design of Electron Beams by J. R. Pierce, published in 1954 by D. van Nostrand Co. (p. 75). Referring to FIG. 5, an electron (e) moving with velocity vector V in a magnetic field with magnetic vector $B_n$ experiences a force that acts at right angles to both $B_n$ and V. (The magnetic vectors of a magnetic field are parallel to its magnetic flux lines.) FIG. 6 shows the trajectory of an electron "a" traveling parallel to the z-axis when it enters a magnetic lens region containing lines of magnetic flux created by a surrounding coil. Because of the relationship shown in FIG. 5, the electron experiences a force in the positive y-direction, which deflects its velocity in that direction. The velocity component in the positive y-direction and the magnetic vector component in the positive z-direction then create a Force acting in the radial direction toward the z-axis, so that the electron spirals in toward the z-axis. As it leaves the magnetic lens region, the electron experiences forces that cause it to spiral in the reverse direction, again toward the z-axis. As a result, the electron is focused to a point "b" on the z-axis. If the magnetic flux density in FIG. 6 is symmetric about the z-axis, then electrons at other points on the incidence plane will experience similar Forces, causing them also to be focused to point "b".

The type of focusing illustrated FIG. 6 applies, for example, in a hybrid Focusing system in which electrostatic prefocusing aligns the electron trajectories parallel to the z-axis. The electron beam velocity is somewhat modulated by electrostatic prefocusing, so it is important for the focal length of the magnetic main lens to be independent of the beam velocity. This condition is satisfied in FIG. 6. Intuitively speaking, the greater the velocity of the incident electron beam, the stronger becomes the force driving it toward the z-axis. Mathematically, the focal length of the magnetic lens is closely related to the rotational period T of an electron about the z-axis, which is given by the equation $$T=(2\pi m/e).(1/B)$$

where m and e are the mass and charge of the electron and B is the magnetic flux density. Note that T does not depend on the velocity of the electron.

In many magnetic focusing systems, the incident electrons do not travel parallel to the z-axis, but diverge from a crossover point. FIG. 7 shows the electron gun of a CRT. The electron gun comprises at least three grids $G_1$, $G_2$, and $G_3$ which are disposed in the neck of the CRT, in Front of the cathode 7. Grid $G_1$ is biased at a negative voltage with respect to cathode 7, while grids $G_2$ and $G_3$ are biased at positive voltages $V_2$ and $V_3$ such that $V_2<V_3$. The crossover is a point disposed in the area between grids $G_1$ and $G_2$ at which the beam is tightly constricted by the electrostatic Fields of these grids. From the crossover point, the beam is accelerated by the potentials of grids $G_2$ and $G_3$, and diverges through progressively larger apertures in these grids.

FIG. 8A is a side view of the trajectories of several electrons as they diverge from the crossover point in the electron gun, then are brought to the focal point by an ideal magnetic lens having a constant flux density, with all magnetic flux lines parallel to the z-axis. FIG. 8B shows these trajectories as seen from the focal point; each electron appears to describe a circle, moving first away from, then back to the z-axis. This circular path results from the relations shown earlier. In FIG. 8C, if an electron is moving with a velocity "v" having a positive x-component $v_x$ and positive z-component $v_z$, the force produced by the positive z-component $B_z$ of the magnetic field will act in the positive y-direction, from below the paper to above the paper in the drawing, as was described in FIG. 5. The motion depicted in FIGS. 8A and 8B is described graphically in FIG. 8D, in which the horizontal axis is the z-axis and the quantities r, $B_0$, and θ are shown on the vertical axis, r being the distance of the electron from the z-axis, $B_0$ the constant magnetic flux density, and θ the angle through which the electron has rotated around one of the circles in FIG. 8B.

Magnetic lenses, like optical lenses, are subject to various types of aberration, including spherical aberration: the tendency of electrons entering the lens at different distances from the z-axis to be brought to focus at different points. Referring to FIG. 9A, the aberration of a magnetic lens depends on its inner diameter "a", its thickness "b," and the beam diameter "r," or the diameter of the neck of the CRT. Increasing "a" in relation to "r" (reducing the ratio r/a) reduces spherical aberration. Increasing the thickness "b" also reduces aberration by making the magnetic flux lines inside the magnetic lens more nearly parallel to the z-axis.

Referring to FIG. 9B, the magnetic flux lines 9 of a magnetic lens are never exactly parallel to the z-axis, but are always curved to a greater or lesser extent. As a result, the magnetic flux density B is not constant but varies as in FIG. 9C, and r and θ also vary as in FIG. 9C, rather than as in FIG. 8D. The thickness "b" of the magnetic lens corresponds to the half-width "2*d*" of the magnetic field, "d" being the distance from the center of the lens, measured along the z-axis, at which the flux density fall to half its maximum value.

From FIGS. 9A and 9B it can be seen that the greater the thickness "b" of a magnetic lens, and the larger its diameter "a" is in relation to "r," the more closely its magnetic flux lines will approximate the ideal case of a uniform magnetic field parallel to the z-axis.

Another important requirement is that the magnetic field generated by the magnetic lens be as symmetrical as possible about the z-axis. Yet another requirement is that the axis of the magnetic lens be aligned with the crossover point of the electron gun. Any asymmetry or misalignment will lead to further lens aberration.

Using a conventional alnico permanent ring magnet, it is difficult to obtain a magnetic lens with satisfactory size, symmetry, and alignment. There are several reasons for this.

An alnico ring magnet is conventionally Fabricated by sand casting, by pouring the molten magnetic material into a mold and allowing it to cool. The cooling rate, however, differs in interior and exterior portions of the mold, creating temperature differences that tend to lead to a non-uniform composition, resulting in loss of symmetry.

A further problem is that remnant oxygen present in the alnico material tends to gasify in the melt, leading to cavities, crystal defects, and cracks, all of which mar the symmetry of the magnetic field generated by the magnet. An alnico ring magnet with a large volume is quite likely to have hidden cavities and cracks in its interior, where they are difficult to detect by inspection.

The alnico magnet that comes out of the mold has a cough and inaccurate surface, which must be ground down to the required dimensions. For alignment and symmetry, it is particularly important to grind the ends of the magnet to a smooth, flat surface, at right angles to the magnet body. The difficulties of producing a large, flat surface by grinding are well known, and the ring shape of the magnet only makes the task harder.

The need to fabricate a new mold whenever the magnet dimensions are changed to accommodate a new CRT design is a further problem. Another problem is the heavy weight of a large alnico ring magnet. The reason that alnico is used despite all these difficulties is that it has good temperature characteristics, as described later.

Another problem with an alnico permanent ring magnet is eddy current loss, which affects dynamic focusing. FIG. 10A shows the position of the dynamic focusing coil 4 in relation to the permanent ring magnet 1. As noted earlier, an alternating current waveform is applied to the dynamic focusing coil 4, to correct for defocusing at the right and left ends of horizontal rasters. This generates a dynamic focusing flux 17, indicated by the symbol ø (t).

FIG. 10B shows how the dynamic focusing flux varies in relation to the waveform of the deflection current applied to the horizontal deflection coils. The dynamic focusing flux ø (t) is zero at the center of the horizontal deflection current waveform. At other points, the flux ø (t) inside the dynamic focusing coil 4 is directed in the negative z-axis direction, so as to weaken the net flux B of the magnetic lens. The current waveform fed to the dynamic focusing coil 4 is parabolic, so that the strength of the flux ø (t) and hence the degree of weakening of B increase as the square of the distance from the center of the horizontal scan.

The focal length of the magnetic lens is related to the pitch P given following equation $$P=P_p x(V^{1/2}\ x(1/B)\cos\phi$$

where $K_p$ is a constant, V is a voltage corresponding to the electron beam velocity, B is the magnetic flux density, and θ is the angle between the beam and the z-axis. If B is weakened, then P increases, and with it the focal length. The dynamic focusing flux waveform ø (t) in FIG. 10B keeps the beam focused on the faceplate through all parts of the horizontal scan.

Referring again to FIG. 10A, however, the dynamic focusing flux 17 also creates eddy currents 18 on the surface of the permanent ring magnet 1. Flowing around the magnetic ring, these currents give rise to a flux 19 in the direction that tends to cancel the dynamic focusing flux 18. This effect increases the peak value of the current that must be fed to the dynamic focusing coil 4 by a factor of $$\{1+WR/L)^2\}^{1/2}$$

where W is the number of turns of the dynamic focusing coil 4, R is the reluctance of the closed magnetic circuit created by the eddy currents, and L is the coil inductance. A phase lag of $\theta=\tan^{-1}(L/RW)$ also occurs, necessitating a phase correction circuit.

The eddy currents 18 arise from an electromotive force induced by the variation of the dynamic focusing flux ø (t) with time, as described by the quantity U=–dø (t)/dt, (in units of volts). The eddy current loss (in units of watts) is proportional to the square of the frequency. Multimedia displays and high-definition CRTs require high horizontal scanning frequencies, such as 15.75 kHz, 31.5 kHz, and 33.75 kHz, at which the eddy current loss is appreciable. The conventional permanent ring magnet accordingly requires extra power for dynamic focusing and an extra circuit for phase correction, and as the horizontal scanning frequency off the input video signal increases, the eddy current loss increases in proportion to the square of the frequency.

Various solutions to the foregoing problems have been proposed in the prior art, some of which are illustrated in FIGS. 11 to 14. Elements in these drawings that are equivalent to elements in FIGS. 1A and 1B are indicated by the same reference numerals.

Japanese Patent Application Kokai Publication No. 74344/1989 discloses a permanent ring magnet that is divided into two portions 1*a* and 1*b*, which are separated by an iron center yoke 20 as illustrated in FIG. 11. This permits a smaller permanent magnet volume, resulting in Fewer cavities and cracks. However, accurate alignment of the two permanent ring magnets 1*a* and 1*b*, center yoke 20, and pole pieces 2*a* and 2*b* with respect to the z-axis becomes more difficult. All are likely to be mis-aligned to some extent, with adverse effects on the symmetry and alignment of the magnetic field. To obtain a symmetrical magnetic lens, the above components must have flat surfaces and strictly controlled dimensions, making them difficult and expensive to manufacture. Moreover, this design does not solve the problem of eddy currents.

FIG. 12 shows a variation of the above design disclosed in Japanese Patent Application Kokai Publication No. 60035/1990, using the same reference numerals to denote the permanent ring magnets 1*a* and 1*b* and center yoke 20. Lead wires 21 from the correcting coil 3 and dynamic focusing coil 4 are brought out through a hole 22 in pole piece 2*a*, and a temperature sensor 23 is attached to the center yoke 20, so that the current red to the correcting coil 3 can be adjusted to compensate for the temperature characteristic of the yoke 20. This design also has a case 24 with an inside tube 24*a* extending through the holes 2*c* in the pole pieces 2*a* and 2*b* and the central hole of the bobbin 5, and an outside cylinder 24*b* that partly covers the permanent ring magnet 1*b* and center yoke 20.

One problem with this design is that the hole 22 in pole piece 2*a* impairs the symmetry of the magnetic focusing Field. Also, although the inside tube 24*a* aids in positioning the other parts on the z-axis, assembly is inconvenient because it is first necessary to attach the temperature sensor 23 to the center yoke 20, and it is difficult to align the permanent ring magnet 1*b* and center yoke 20 correctly on the z-axis when they are held by the outer cylinder 24*b* of the case.

The difficulty of manufacturing a large permanent ring magnet was addressed by Japanese Utility Patent Application Kokai Publication No. 2567/1981. Referring to FIG. 13A, this design employs a large number of small cylindrical rod magnets 1s, which are held between the pole pieces 2*a* and 2*b*. The correcting coil 3 and lead wires 21 are as described previously. FIG. 13B shows a perspective drawing of one rod magnet 1s. The rod magnets 1s are disposed in mutual contact with one another as shown in FIG. 13C.

Although the cylindrical rod magnets 1s can be manufactured with comparative ease, once they are assembled in mutual contact as shown in FIG. 13C, they function as a single permanent ring magnet and are still subject to the eddy-current loss described in FIG. 10A, making it necessary to apply extra dynamic focusing current.

Another possible solution to the difficulty of manufacturing a large alnico ring magnet would be to use a ferrite ring magnet instead. Ferrite magnets are made by sintering ferrite powder. Although heavy and not as strongly magnetic as alnico, ferrite magnets are free of cavities and cracks, have a uniform composition, and can be made with good dimensional accuracy. Moreover, their high specific resistance, on the order of $10^{10}\Omega$ cm, reduces the problem of eddy currents.

A problem with using a ferrite magnet, however, is that its magnetic flux density varies with temperature. The temperature coefficient of a ferrite magnet is –0.2%/° C., or about ten times the alnico value of –0.02%/° C. CRTs must operate over a wide temperature range. The operating temperature range at the neck of a CRT is, for example, from 0° C. and 80° C. With a ferrite permanent magnet, temperature variations in this range would cause noticeable changes in focal length. The beam would be in focus only within narrow temperature limits.

To overcome this obstacle to the use of ferrite magnets, Japanese Patent Application Kokai Publication No. 82949/1982 discloses the focusing system shown in FIG. 14, having steel temperature compensation rings 25*a* and 25*b* surrounding the ends of a permanent ferrite magnet 1. The permeability of the steel rings 25*a* and 25*b* decreases with rising temperature, and their magnetic reluctance increases, so that less magnetic flux can pass through them and more of the magnetic flux must pass through the pole pieces 2*a* and 2*b*. This effect compensates for the weakening of the magnetic field generated by the ferrite permanent magnet 1 at higher temperatures.

This technique produces a reasonably flat temperature characteristic in the range from about 10° C. to 50° C., but the characteristic exhibits steep changes at higher and lower temperatures, because of imperfect balance between the temperature characteristics of its different component materials. Focusing performance therefore tends to degrade severely under extreme environmental conditions.

Another difficulty with this design is that, since it performs temperature compensation by controlling external flux leakage, the shape of the temperature characteristic depends strongly on the dimensional accuracy of the permanent magnet 1 and compensation rings 25*a* and 25*b*. In practice, the shape of the temperature characteristic tends to be highly variable.

Another method of temperature compensation is to sense the temperature of the ferrite permanent magnet and control the current fed to the correcting coil so as to compensate for the decrease in magnetic flux at higher temperatures, as described in, for example, Japanese Patent Application Kokai Publication Nos. 171040/1986, 256883/1989, and 20174/1990. A difficulty with these schemes is that a ferrite magnet has high specific heat, making it difficult to measure the temperature at the center of the magnet by sensing the temperature at an arbitrary point on its surface. The large thermal inertia of a ferrite permanent magnet also makes it slow to respond to temperature changes, so that focusing characteristics appear to drift with changing temperature.

To summarize the above discussion of the prior art, a magnetic focusing system requires a large, symmetric magnetic lens that is accurately aligned with and centered on the z-axis. If the magnetic lens uses a permanent magnet, to obtain a symmetric lens, the magnet must have a uniform composition and accurate dimensions. If the lens will be used in a CRT with a high horizontal scanning frequency, it should be structured so that eddy currents will not interfere with dynamic focusing. The focal length of the lens should also be insensitive to temperature variations.

SUMMARY OF THE INVENTION

One object of the present invention is to improve the magnetic lens symmetry of a magnetic focusing system employing a permanent magnet.

Another object is to obtain a magnetic focusing system utilizing permanent magnets that are easy to manufacture.

Yet another object is to obtain a magnetic focusing system in which the permanent magnets have a uniform composition and are free from cavities and cracks.

Still another object Is to obtain a magnetic focusing system that is easy to assemble and align.

Yet another object is to obtain a magnetic focusing system in which dynamic focusing is not opposed by eddy currents.

Still another object is to provide accurate temperature compensation in a magnetic focusing system.

The invented magnetic focusing system comprises a pair off pole pieces and a plurality of permanent rod magnets. The north poles of the permanent rod magnets are disposed in contact with one of the pole pieces at equally-spaced points around its outer perimeter. The south poles of the permanent rod magnets are disposed in contact with the other pole piece at equally spaced points around its outer perimeter. The permanent rod magnets are not in mutual contact with one another. The pole pieces have central holes. Magnetic flux in the space between the inner rims of these holes forms a magnetic lens.

DETAILED DESCRIPTION OF THE INVENTION

Embodiments of the invention will be described with reference to the attached drawings. These drawings illustrate the invention but do not restrict its scope, which should be determined solely from the appended claims.

Embodiment 1

Figure 15A:
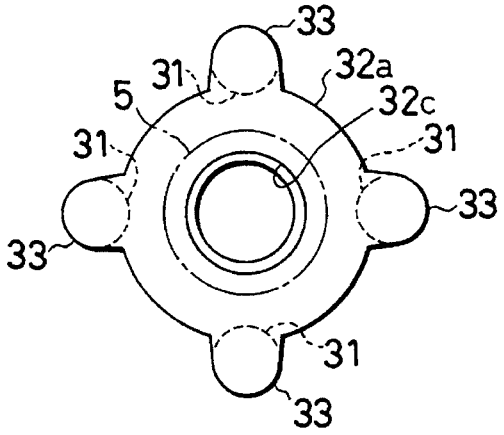
FIG. 15A is a frontal view of a first embodiment of the invented focusing system.

Referring to FIG. 15A, the first embodiment comprises four manganese-aluminum permanent rod magnets 31 and a pair of identical iron pole pieces 32*a* and 32*b* (only pole piece 32*a* is shown). The pole pieces 32*a* and 32*b* have the form of flat circular discs with central holes 32*c* to admit the neck of a CRT, and with four semicircular projections 33 disposed around their perimeters, mutually separated at 90° angles from one another. The ends of the permanent rod magnets 31 are seated against the projections 33, so that the perimeters of the permanent rod magnets 31 are aligned with the perimeters of the projections 33. The rod magnets 31 do hoe make mutual contact with one another. A hollow bobbin 5 is disposed within this structure, parallel to the rod magnets 31.

Figure 15B:
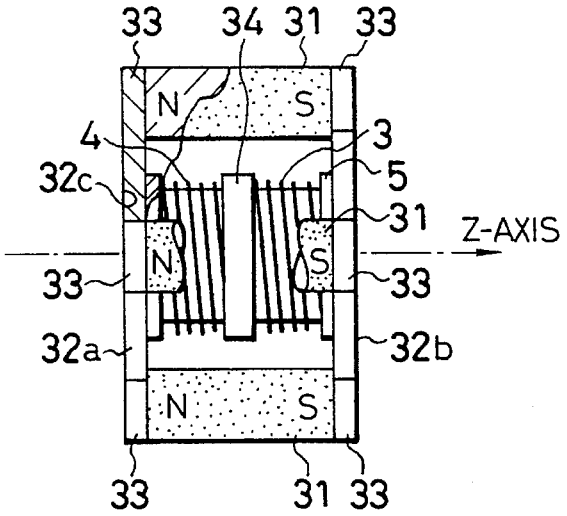
FIG. 15B is a sectional side view of the first embodiment.

Referring to FIG. 15B, a correcting coil 3 and dynamic focusing coil 4 are wound on the bobbin 5. The correcting coil 3 and dynamic focusing coil 4 are separated by a plastic partition 34. The permanent rod magnets 31 are magnetized parallel to the central axis (z-axis) of the assembly. Their north-pole ends make contact with pole piece 32*a*, and their south-pole ends with pole piece 32*b*.

The permanent rod magnets 31, the pole pieces 32*a* and 32*b*, and the central space between them form a magnetic circuit. Magnetic flux lines flow from the north poles of rod magnets 31 through pole piece 32*a* to the rim of the central hole 32*c* in pole piece 32*a*, thence through space to the rim of the central hole 32*c* in pole piece 32*b*, and return through pole piece 32*b* to the south poles of rod magnets 31, creating a magnetic lens in the space between the central holes 32*c* of pole pieces 32*a* and 32*b*.

The permanent rod magnets 31 are manufactured by sintering a manganese-aluminum powder. This process ensures a highly uniform composition, free of cavities and cracks. Good dimensional accuracy can also be attained easily, the dimensional accuracy depending only on the accuracy of the mold. After sintering, the ends of the permanent rod magnets 31 are ground and polished to flat surfaces, a process facilitated by the small cross-sectional area of the magnets 31.

Figure 13A:
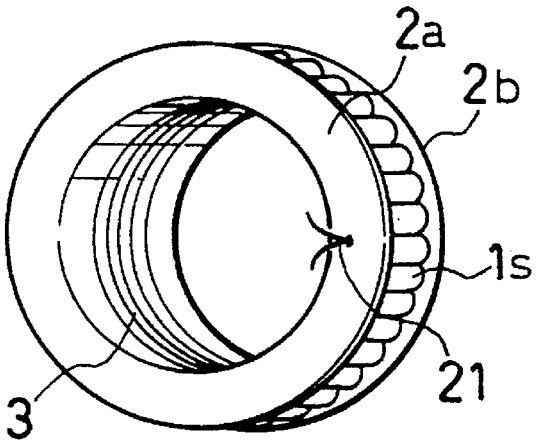
FIG. 13A PRIOR ART
FIG. 13A is a perspective drawing of a conventional focusing system employing a ring magnet comprising a plurality of permanent rod magnets.
Figure 13B:
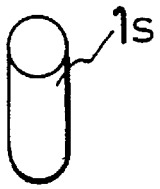
FIG. 13B PRIOR ART
FIG. 13B is a perspective drawing of one of the rod magnets in FIG. 13A.
Figure 13C:
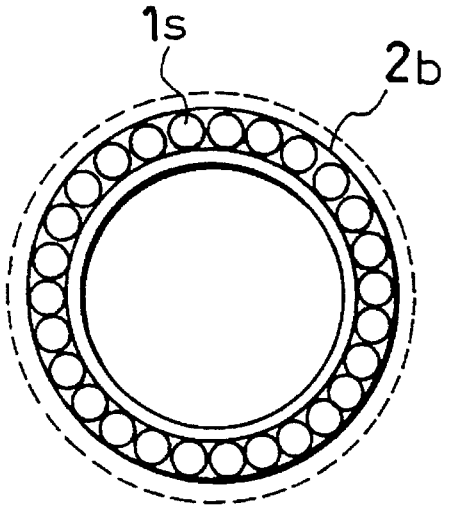
FIG. 13C PRIOR ART
FIG. 13C is a frontal plan view of the conventional focusing system in FIG. 13A.
Figure 14:
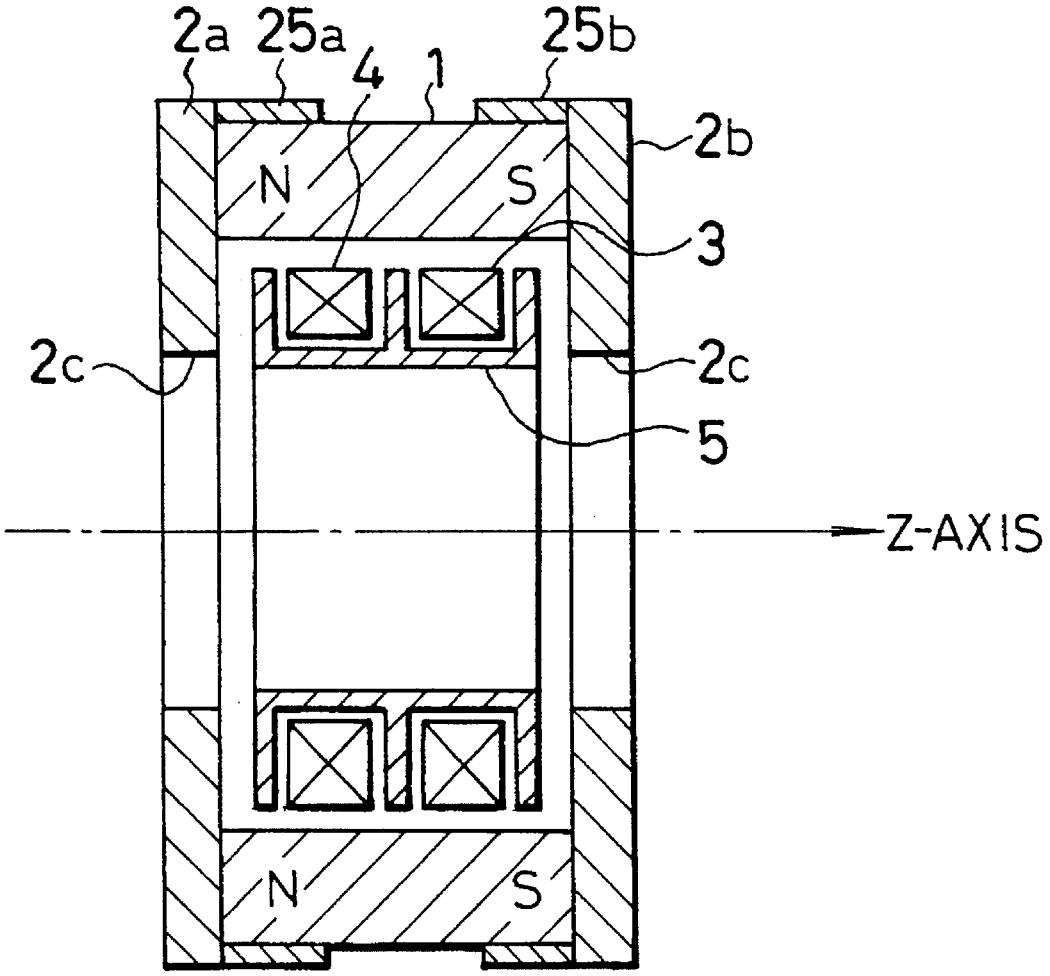
FIG. 14 PRIOR ART
FIG. 14 illustrates a conventional focusing system with steel temperature compensation rings.

The uniformity and dimensional accuracy of the permanent rod magnets 31 enhance the symmetry of the magnetic lens. In comparison with the prior art of FIG. 13A, the relatively small number of permanent rod magnets 31 is also an advantage, because it reduces the total area of contact between the permanent rod magnets 31 and pole pieces 32*a* and 32*b*. No matter how accurately the contact surfaces are formed, at the microscopic level there will be irregularities and gaps that generate magnetic reluctance, impairing the regularity off the magnetic circuit. Reducing the total area of contact between the permanent rod magnets 31 and the pole pieces 32*a* and 32*b* thus helps to preserve the symmetry of the magnetic lens.

Another factor enhancing the symmetry of the magnetic lens is that the magnetic permeability $\mu_r$ of the manganese-aluminum material is about 1.1 to 1.3, close to the permeability of air (1.0). This creates a more uniform magnetic circuit. For comparison, the permeability $\mu_r$ of alnico is about 3.0 to 5.0.

The symmetry of the magnetic lens also depends on the distance of the permanent rod magnets 31 from the z-axis, greater distances giving greater symmetry. Here the small number of permanent rod magnets 31 is a distinct advantage, as it is much easier to support four rod magnets 31 at a large distance from the z-axis than it would be to support an entire ring magnet. For example, the permanent rod magnets 31 can easily be supported at a distance from the z-axis equal to four times the radius of the neck of the CRT, which gives a satisfactorily symmetric magnetic lens.

Figure 16:
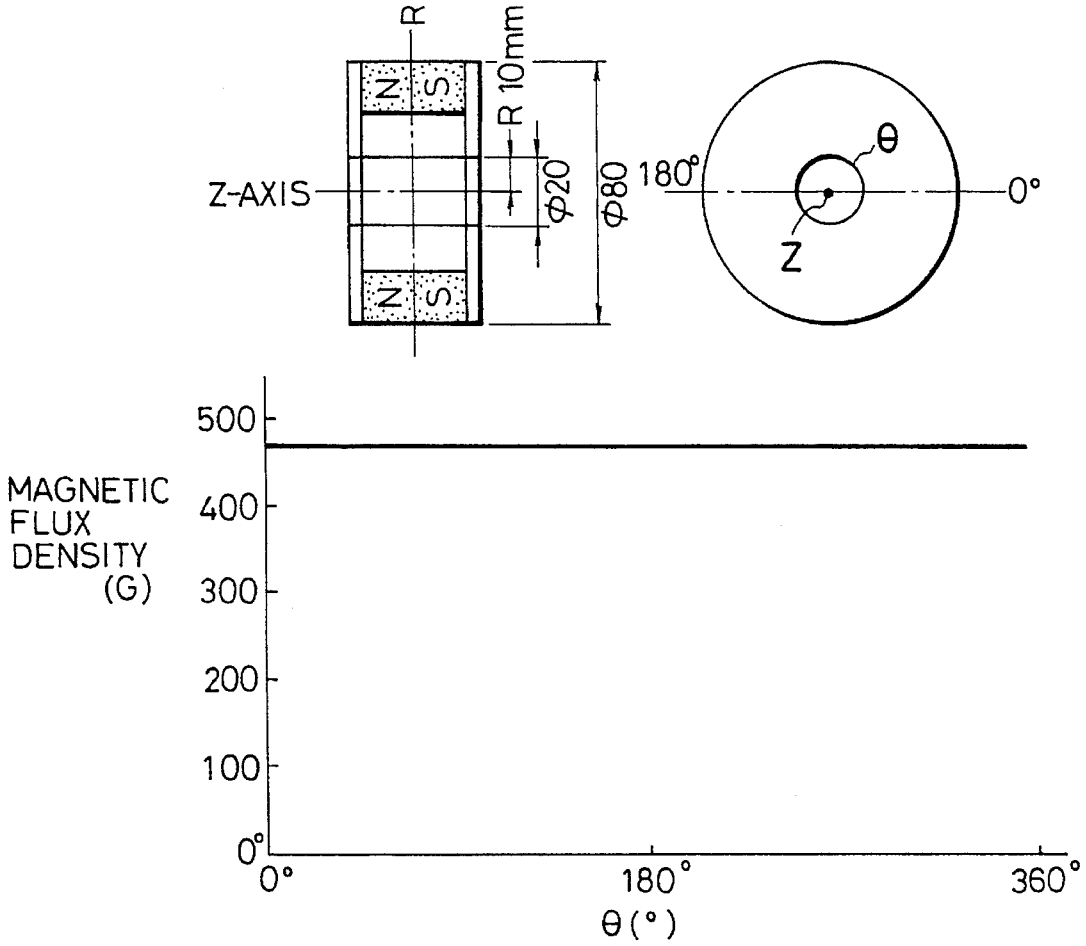
FIG. 16 is a graph illustrating the symmetry of the magnetic lens in the first embodiment.

Referring to FIG. 16, the symmetry of the magnetic lens can be expressed graphically by measuring the magnetic flux density around a circle located in the radial plane R and centered on the z-axis, with a radius of, for example, 10 mm, at angles θ from 0° to 360°. In the graph at the bottom of FIG. 16, the angle θ is plotted on the horizontal axis and magnetic flux density in gauss units (G) is plotted on the vertical axis. If the distance from the z-axis to the outer perimeter of the permanent rod magnets 31 is 80 mm, as shown, the flux density graph is substantially a straight line, indicating the same symmetry as if the magnetic field had been produced by an extremely accurately-configured permanent ring magnet.

Mathematically, the non-uniformity of the flux density can be expressed by finding the maximum and minimum flux density values on the circle in FIG. 16, dividing their difference by the maximum value, and converting the result to a per cent value as follows.

$$\text{Non-uniformity} = \frac{(\text{maximum density} - \text{minimum density})}{\text{maximum density}} \times 100$$

With suitable design, non-uniformity defined in this way can be held to within about one per cent.

The symmetry of the magnetic lens simplifies the alignment of its axis with the electron gun so that the crossover is on the z-axis. Having to align four separate permanent rod magnets 31 is not a disadvantage, for each rod magnet 31 can be aligned much more easily than a conventional ring magnet could be aligned. Moreover, if one of the permanent rod magnets 31 is slightly mis-aligned this need not affect the alignment of the other three rod magnets 31, so the symmetry and alignment of the magnetic lens as a whole is compromised only slightly.

Because the permanent rod magnets 31 are not in mutual contact, they do not carry eddy currents in a ring around the neck of the CRT. Dynamic focusing may still create small eddy currents flowing around the surfaces of individual rod magnets 31, but the magnetic flux generated by these eddy currents, when led through the pole pieces 32*a* and 32*b* into the space between the two central holes 32*c*, reinforces, rather than opposes, the dynamic focusing flux. Although there is an energy loss associated with these eddy currents, since the currents are small the loss is slight, and dynamic focusing remains efficient even at high horizontal scanning frequencies.

Figure 17:
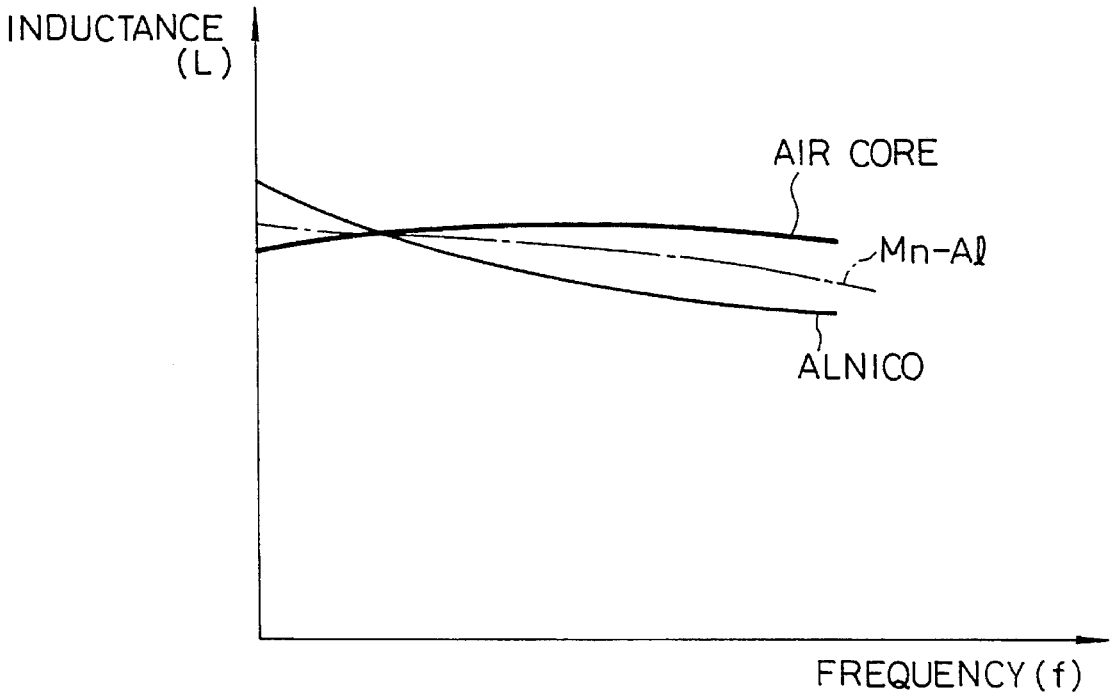
FIG. 17 is as graph illustrating the inductance of a dynamic focusing coil as a function of horizontal scanning frequency.

FIG. 17 shows the relation of the inductance L of the dynamic focusing coil 4 to the horizontal scanning frequency f, with L on the vertical axis and f on the horizontal axis. If the dynamic focusing coil 4 had an air core, with no permanent magnets or other magnetic materials in its vicinity, no eddy currents would arise to cancel the magnetic flux of the coil, and its inductance L would be substantially constant, as indicated by the solid line labeled "air core." In the presence of the conventional alnico permanent ring magnet, eddy currents reduce the inductance L at higher frequencies f, as indicated by the solid line labeled "alnico." The present embodiment provides an inductance characteristic intermediate between these two characteristics, as indicated by the dash-dot line labeled "Mn-Al." Although there is some decrease in dynamic focusing efficiency at higher frequencies f, the decrease is slight. The relative flatness of this induction characteristic makes the invention suitable for multimedia displays that must adapt to a variety of horizontal scanning frequencies, e.g. the scanning frequencies of standard television, enhanced-definition television, high-definition television, and computer-generated displays.

A final advantage of the first embodiment is that the dimensions of the permanent rod magnets 31 can be standardized for use with a variety of CRT models. This Further simplifies the manufacture of the rod magnets 31 and reduces their cost. To adapt to different CRT designs, it is only necessary to change the dimensions of the pole pieces 32*a* and 32*b*.

Embodiment 2

Figure 18A:
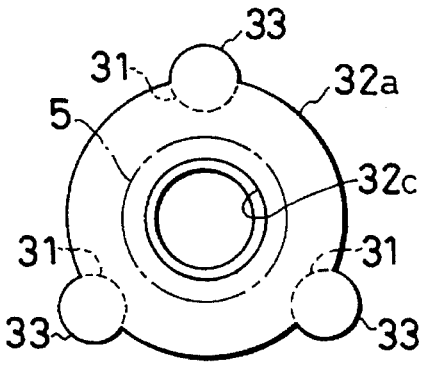
FIG. 18A is a frontal view of a second embodiment of the invented focusing system.
Figure 18B:
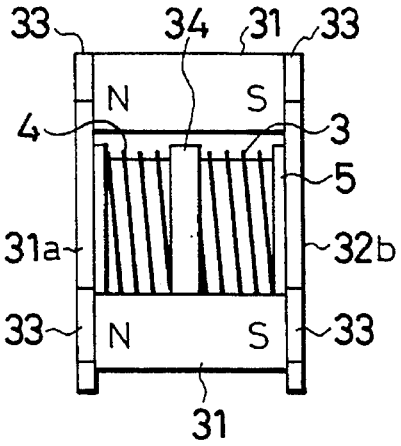
FIG. 18B is a sectional side view of the second embodiment.

FIG. 18A shows a second embodiment, differing from the first embodiment in having only three permanent rod magnets 31, separated from one another by angles off 120°. The pole pieces 32*a* and 32*b* accordingly have only three projections 33. FIG. 18B shows this embodiment in a side view. The correcting coil 3, dynamic focusing coil 4, and bobbin 5 are the same as in the first embodiment.

Use of only three permanent rod magnets 31 reduces the weight and cost of the magnetic focusing system. It also somewhat degrades the symmetry of the magnetic lens, but if the dimensions of the permanent rod magnets 31 and pole pieces 32*a* and 32*b* are optimized, it is still possible to obtain substantially the same symmetry as with a conventional ring magnet.

Embodiment 3

Figure 19A:
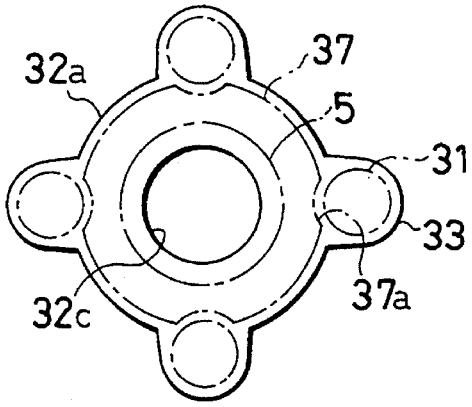
FIG. 19A is a frontal view of a third embodiment of the invented focusing system.
Figure 19B:
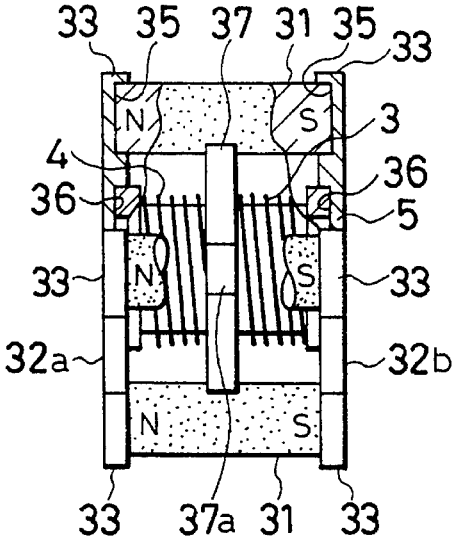
FIG. 19B is a sectional side view of the third embodiment.

FIGS. 19A and 19B show frontal and side views of a third embodiment, using the same reference numerals as for the first and second embodiments, except for the partition 37 between the correcting coil 3 and dynamic focusing coil 4. Referring to FIG. 19B, the projections 33 of the pole pieces 32*a* and 32*b* have circular depressions 35 for receiving the ends of the permanent rod magnets 31, and the pole pieces 32*a* and 32*b* also have circular recessions 36 around the inside rims of the central holes 32*c* for receiving the ends of the bobbin 5. The partition 37 has a larger diameter than in the first two embodiments, and its perimeter has four circular indentations 37*a* that fit against and support the four permanent rod magnets 31. The partition 37 and indentations 37*a* are also indicated in FIG. 19A.

The recessions 36 hold the bobbin 5 in alignment with the z-axis. The depressions 35 and partition 37 hold the permanent rod magnets 31 in alignment with the z-axis, and at equal distances from the z-axis. The focusing system is therefore easy to assemble and easy to align, and can assure a highly symmetric focusing field.

The depressions 35 and 36 and the large partition 37 with its peripheral indentations 37*a* can also be employed in the second embodiment, or in the fourth embodiment which follows.

Embodiment 4

Figure 20A:
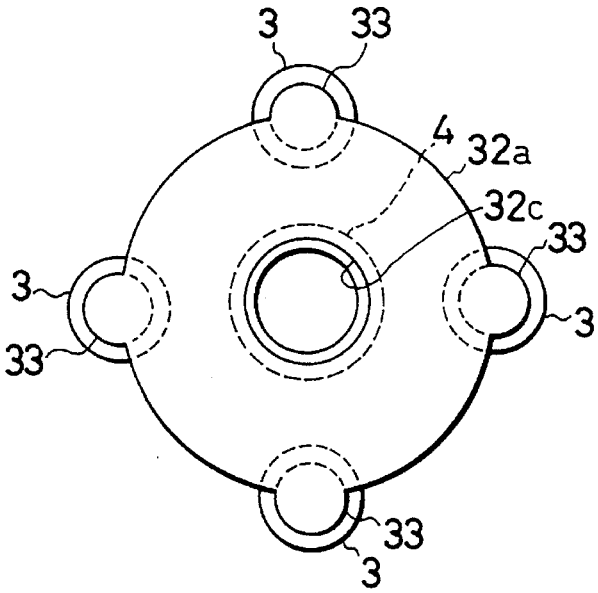
FIG. 20A is a frontal view of a fourth embodiment of the invented focusing system.
Figure 20B:
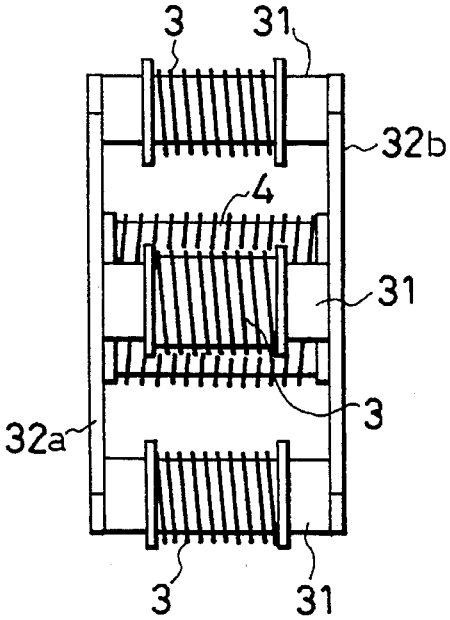
FIG. 20B is a sectional side view of the fourth embodiment.

FIGS. 20A and 20B show frontal and side views of a fourth embodiment, using the same reference numerals as in the first two embodiments. The fourth embodiment differs from the preceding embodiments in having four correcting coils 3, which are wound around the four permanent rod magnets 31. Accordingly, only the dynamic focusing coil 4 is wound on the bobbin 5 and no partition is required.

Independent direct currents can be applied to the four correcting coils 3, making it possible to apply precise corrections for magnetic unbalance resulting from minor variations in magnet fabrication. It also becomes possible For the correcting coils 3 to extend over substantially the entire length of the permanent rod magnets 31, and for the dynamic focusing coil 4 to extend over substantially the entire length of the bobbin 5, so that dynamic focusing can operate on the electron beam over a greater distance than in the preceding embodiments. This improves the efficiency of dynamic focusing, making the fourth embodiment particularly suitable for use with high-definition CRTs.

Embodiment 5

Figure 21A:
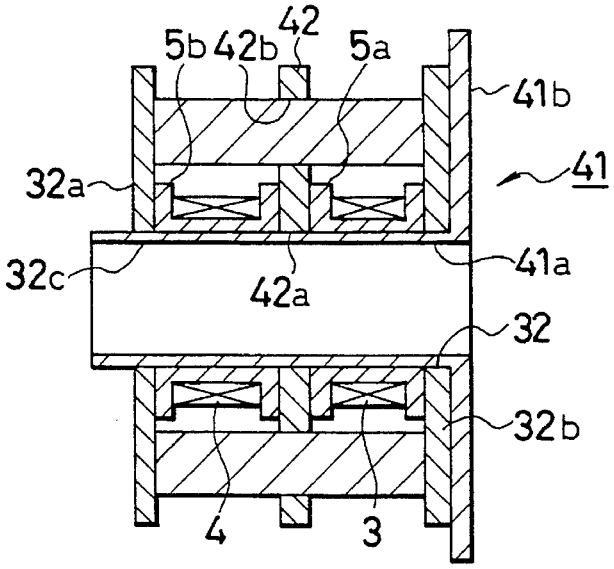
FIG. 21A is a sectional side view of a fifth embodiment of the invented focusing system.
Figure 21B:
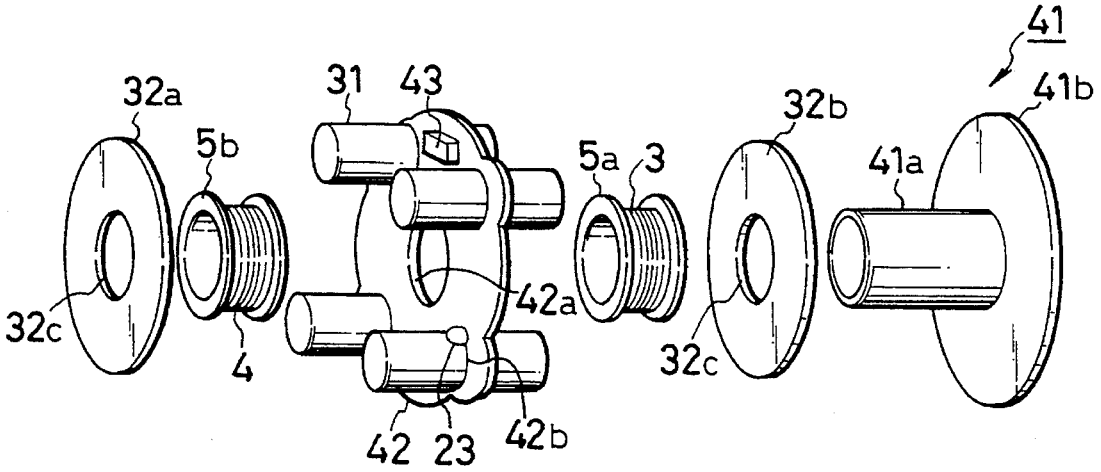
FIG. 21B is an exploded view of the fifth embodiment.

FIGS. 21A and 21B show a side view and exploded view of a Fifth embodiment, using the same reference numerals as in the preceding diagrams to indicate the correcting coil 3, dynamic focusing coil 4, permanent rod magnets 31, pole pieces 32*a* and 32*b*, and their central holes 32*c*. Separate bobbins 5*a* and 5*b* are now provided for the correcting coil 3 and dynamic focusing coil 4.

The fifth embodiment has a flanged tube 41, the tube part 41*a* of which runs through the central holes in pole pieces 32*a* and 32*b* and bobbins 5*a* and 5*b*, and through the central hole 42*a* in an alignment board 42. The flange 41*b* of the flanged tube 41 extends outward at right angles from one end of the tube 41*a*, providing a rigid base against which pole piece 32*b* can be held in correct alignment. The alignment board 42 is a printed circuit board, which also has four holes 42*b* through which the four permanent rod magnets 31 are inserted, and by which they are held in their correct positions. A connector 43 is mounted on the alignment board 42 for feeding current via printed wiring traces to the correcting coil 3 and dynamic focusing coil 4, and For interconnecting a temperature sensor 23, which is mounted on the alignment board 42 in contact with one of the permanent rod magnets 31, to external circuitry.

Since the permanent rod magnets 31 are correctly positioned by the holes 42*b* in the alignment board 42, the projections on pole pieces 32*a* and 32*b*, which helped align the rod magnets 31 in the preceding embodiments, are less necessary, and have been omitted from the drawing.

This embodiment is assembled in the following order. First the correcting coil 3 and dynamic focusing coil 4 are wound on their bobbins 5*a* and 5*b*. Then the tube 41*a* is inserted through pole piece 32*b*, bobbin 5*a*, and alignment board 42, and the lead wires of correcting coil 3 are connected to alignment board 42. Next the permanent rod magnets 31 are inserted through their holes in alignment board 42 and seated with their south-pole ends flat against pole piece 32*b*. Then bobbin 5*b* is mounted on tube 41*a* and the lead wires of dynamic focusing coil 4 are connected to alignment board 42. Finally pole piece 32*a* is placed on tube 41*a*, flat against the north-pole ends of rod magnets 31, and the entire assembly is secured. If the dimensions of the rod magnets 31 and alignment board 42 are accurate, then accurate alignment of the assembly is attained without the need for exacting measurements and adjustments.

Figure 22:
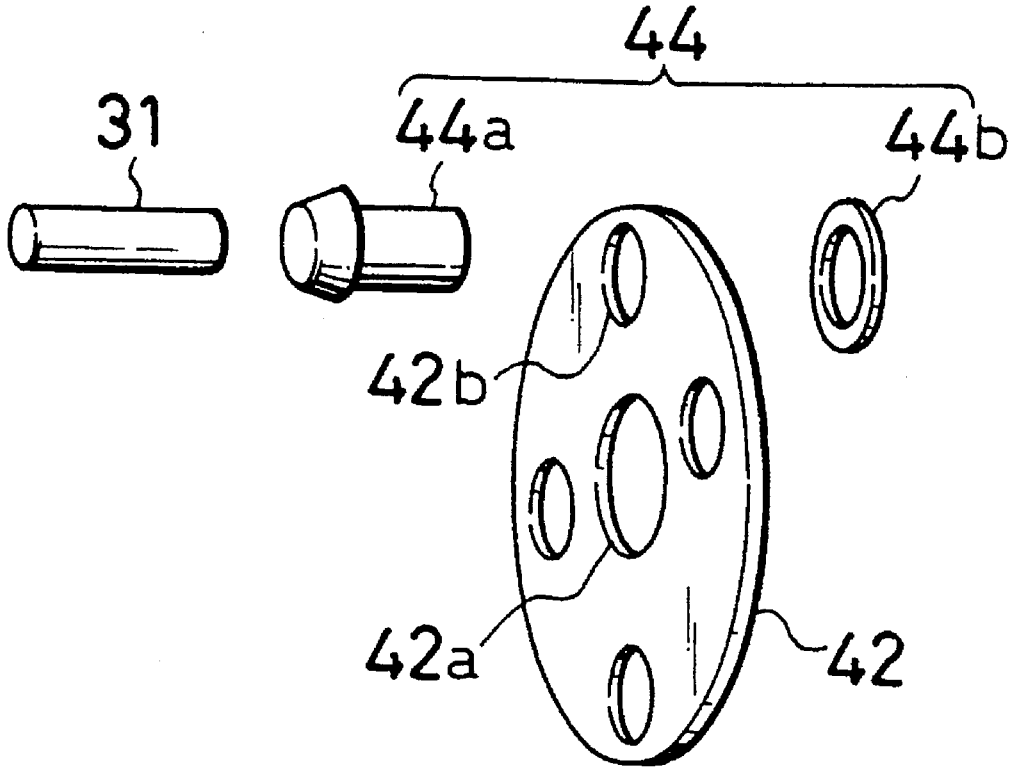
FIG. 22 illustrates a variation of the fifth embodiment.

Referring to FIG. 22, to hold the permanent rod magnets 31 more accurately in the holes 42*b* in the alignment board 42, these holes 42*b* may be provided with collared jackets 44*a* and fasteners 44*b*. The collared jackets 44*a* are inserted through the holes 42*b* and fastened by the fasteners 44*b*, then the permanent rod magnets 31 are inserted through the jackets 44*a*. The alignment board 42, jackets 44*a*, and fasteners 44*b* constitute a supporting structure 44 that provides firm support for the rod magnets 31.

Embodiment 6

Figure 23A:
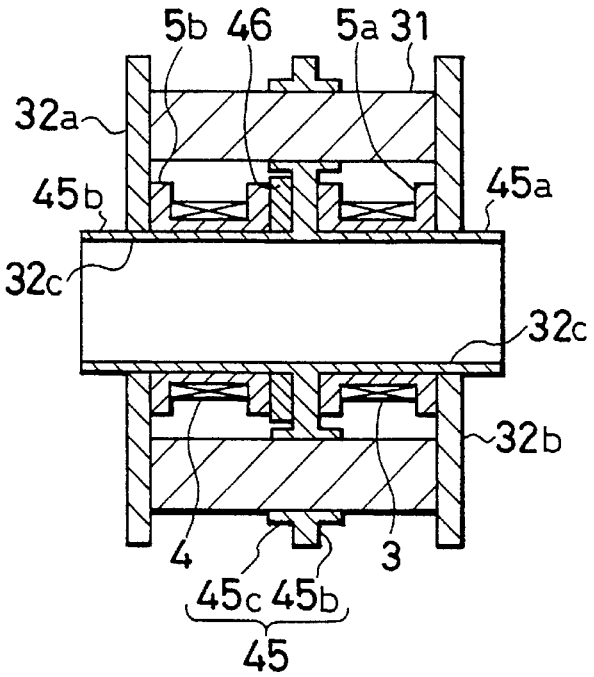
FIG. 23A is a sectional side view of a sixth embodiment of the invented focusing system.
Figure 23B:
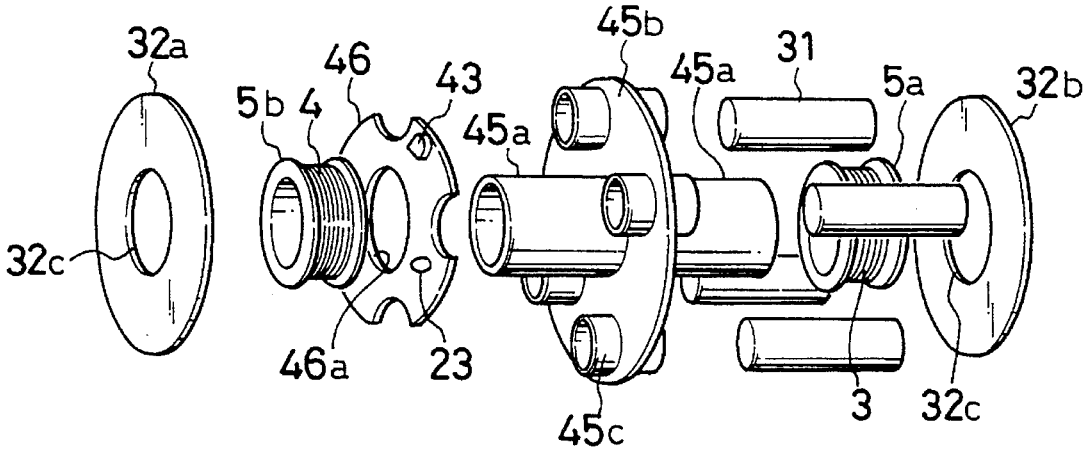
FIG. 23B is an exploded view of the sixth embodiment.

FIGS. 23A and 23B show a side view and exploded view of a sixth embodiment. The same reference numerals as in the fifth embodiment are used to identify the correcting coil 3, dynamic focusing coil 4, bobbins 5*a* and 5*b*, temperature sensor 23, permanent rod magnets 31, pole pieces 32*a* and 32*b*, their central holes 32*c*, and connector 43, which have the same functions as in the fifth embodiment.

The sixth embodiment has a flanged tube 45 comprising a cylindrical tube 45*a*, a flange 45*b* extending outward at right angles from a central part of the tube 45*a*, and tubular magnet holders 45*c*, which are disposed in the flange 45*b* in four symmetrical positions with respect to the tube 45*a*. The tube 45*a* extends through the central holes in the pole pieces 32*a* and 32*b* and bobbins 5*a* and 5*b*. A printed circuit board 46 with a central hole 46*a* is disposed between the flange 45*b* and bobbin 5*b*. The temperature sensor 23 and connector 43 are mounted on this printed circuit board 46.

This embodiment is assembled as follows. First, the correcting coil 3 and dynamic focusing coil 4 are wound on their bobbins 5*a* and 5*b* and the temperature sensor 23 and connector 43 are mounted on the printed circuit board 46. Printed circuit board 46 and bobbins 5*a* and 5*b* are then slipped over tube 45*a*. Next lead wires from correcting coil 3 and dynamic focusing coil 4 are connected to printed circuit board 46; then the permanent rod magnets 31 are inserted through the tubular magnet holders 45*c* on flange 45*b*. Finally the pole pieces 32*a* and 32*b* are mounted on tube 45*a*, and the entire assembly is secured. As in the fifth embodiment, accuracy of assembly is determined by the dimensional accuracy of the components, but the assembly work is made easier and its accuracy is improved by the unitary construction of the flanged tube 45 and central location of the flange 45*b*.

Temperature Compensation

Figure 24:
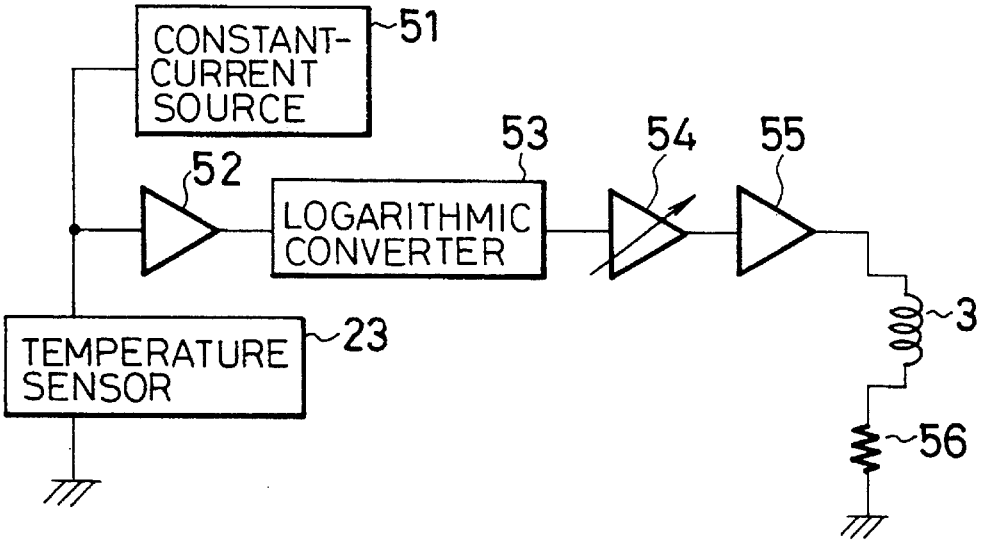
FIG. 24 illustrates a correcting circuit for use in the invented focusing system.

FIG. 24 shows a correcting circuit for controlling the direct current applied to the correcting coil 3 in response to the output of the temperature sensor 23 in the fifth and sixth embodiments. The temperature sensor 23 is, for example, a thermistor coupled between a constant-current source 51 and ground so as to generate a voltage output signal at a point between the temperature sensor 23 and constant-current source 51. This output signal is amplified by an amplifier 52, then fed through a logarithmic converter 53 and output trimmer 54 to a driver 55, which feeds current into the correcting coil 3. The current in the correcting coil 3 is sensed by a current-sensing resistor 56.

The logarithmic converter 53 is, for example, a logarithmic amplifier. The output trimmer 54 may be a potentiometer or variable-gain amplifier coupled to a manual focus control. Alternatively, the logarithmic converter 53 may be a microcontroller programmed to convert the voltage signal output by the amplifier 52 to a digital value, take the logarithm of tills value, then convert the result back to an analog voltage, in which case the microcontroller can also be programmed to carry out the function of the output trimmer 54.

Figure 25A:
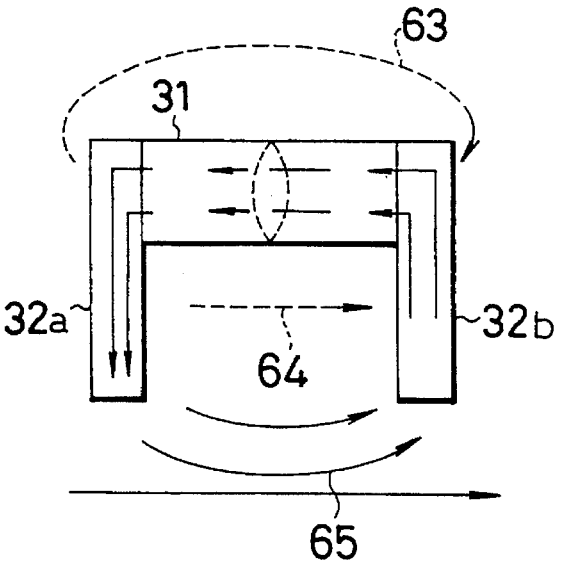
FIG. 25A is a schematic diagram of the magnetic circuit in the invented focusing system.
Figure 25B:
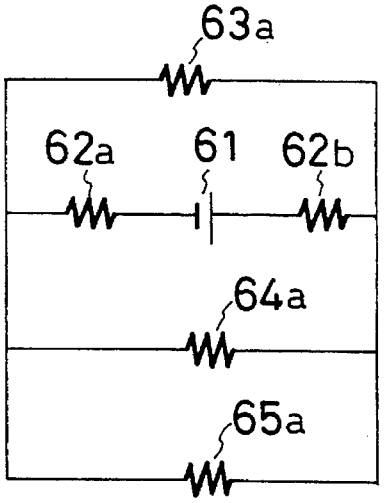
FIG. 25B is an equivalent electrical circuit diagram of the magnetic circuit in FIG. 25A.

FIG. 25A is a schematic diagram of the magnetic circuit in the focusing system, and FIG. 25B is an equivalent circuit diagram of this magnetic circuit. The magnetomotive force generated by the permanent rod magnets 31 in FIG. 25A is represented by a battery 61 in FIG. 25B. The reluctance of the pole pieces 32*a* and 32*b* in FIG. 25A is represented by resistors 62*a* and 62*b* in FIG. 25B. External leakage flux 63 in FIG. 25A encounters a magnetic reluctance represented by resistor 63*a* in FIG. 25B. Leakage flux 64 between the pole pieces 32*a* and 32*b* encounters a reluctance represented by resistor 64*a* in FIG. 25B. The focusing flux 65 of the magnetic lens in FIG. 25A encounters a reluctance represented by resistor 65*a* in FIG. 25B. From these circuit diagrams it can be inferred that the density of the magnetic focusing flux 65 is a linear function of the magnetomotive force 61.

The relative values of the magnetic reluctances represented by the resistors in FIG. 25B are determined by external factors such as structural factors and do not vary with temperature. The magnetomotive force 61, however, varies in inverse ratio to the temperature. For a sintered manganese-aluminum magnet:, the coefficient of temperature variation is −0.11%/°C. Accordingly, there is a linear relationship between flux density and the reciprocal of the temperature.

Figure 26:
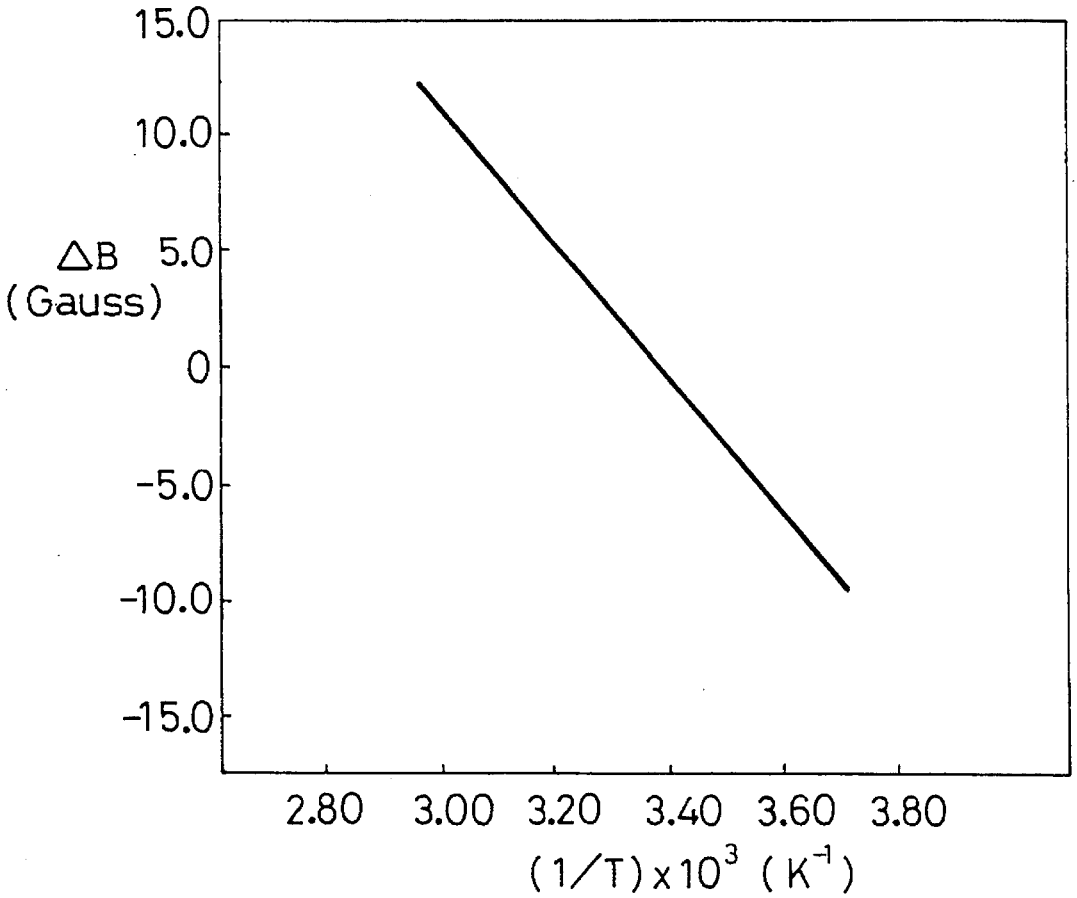
FIG. 26 is a graph of the temperature characteristic of a sintered manganese-aluminum magnet.

FIG. 26 shows this linear relationship in the following way. The horizontal axis indicates reciprocal temperature in kelvins$^{-1}$, multiplied by one thousand. The vertical axis indicates the magnetic flux density produced by the manganese-aluminum rod magnets 31 at room temperature (25° C.), on a relative Gauss scale. The zero point of this scale is the value that gives correct focus in operation at room temperature. In operation at higher or lower temperatures, correct focus requires magnets with different room-temperature flux densities, as shown by the graph line. The vertical scale indicates the difference (ΔB) in Gauss. Measured data are in good agreement with the theoretical line in FIG. 26, demonstrating that the relationship between magnetic flux density and reciprocal temperature is indeed linear over the temperature range of interest.

In the fifth and sixth embodiments, the temperature sensor 23 was disposed in contact with the surface of one of the permanent rod magnets 31. When the invention is applied in, for example, a projection television set, it can be anticipated that the permanent rod magnets 31 will be in thermal equilibrium, since there are normally no extraneous heat sources in the vicinity of the neck of the CRT. If the permanent rod magnets 31 do not have an extremely high thermal resistance and if the ambient temperature does not change quickly, then the permanent rod magnets 31 will not have internal temperature gradients; their internal temperature will be uniform and equal to their surface temperature, so that measuring the surface temperature of one of the permanent rod magnets 31 gives an accurate picture of the temperature throughout all the permanent rod magnets 31. This is due to the uniform composition of the permanent rod magnets 31.

The resistance $R_T$ of a thermistor-type temperature sensor 23 at temperature T (measured in kelvins) can be derived from the equation $$B=[ln(R_T/R_0)]/(1/T-1/T_0)$$

where B is the thermistor constant, and $T_0$ is a known temperature giving a known resistance $R_0$. Changes in the temperature of the permanent rod magnets 31 are detected as changes in the resistance of the temperature sensor 23 according to this equation.

If the constant-current source 51 produces a constant current $I_{ref}$, the voltage output $V_T$ of the temperature sensor 23 at temperature T is given as follows.

$$V_t=R_tI_{ref}=R_0I_{ref}exp[B(1/T-1/T_0)]$$

The output voltage varies exponentially as the reciprocal temperature. The logarithmic converter 53, however, performs a logarithmic conversion on this equation, giving $$ln(V_T)=ln(R_0I_{ref})+B(1/T-1/T_0)$$

There is accordingly a linear relationship between the output off the logarithmic converter 53 and reciprocal temperature 1/T. After appropriate adjustment by the output trimmer 54, the converted output signal from the logarithmic converter 53 controls the current fed to the correcting coil The correction flux density $B_r$ generated by the correcting coil 3 is linearly related to this current, being given by the equation $$B_r=\mu ni$$

where "μ" is the permeability, "n" is the number of turns, and "i" is the current. The mutual relationships among the correction flux density $B_r$, current i, converted voltage $ln(V_t)$, and reciprocal temperature 1/T are all linear, so in particular there is a .Linear relationship between the correction flux density $B_r$ and reciprocal temperature 1/T. The circuit in FIG. 24 is thus capable of correcting accurately for changes in flux density resulting from changes in temperature.

Figure 27:
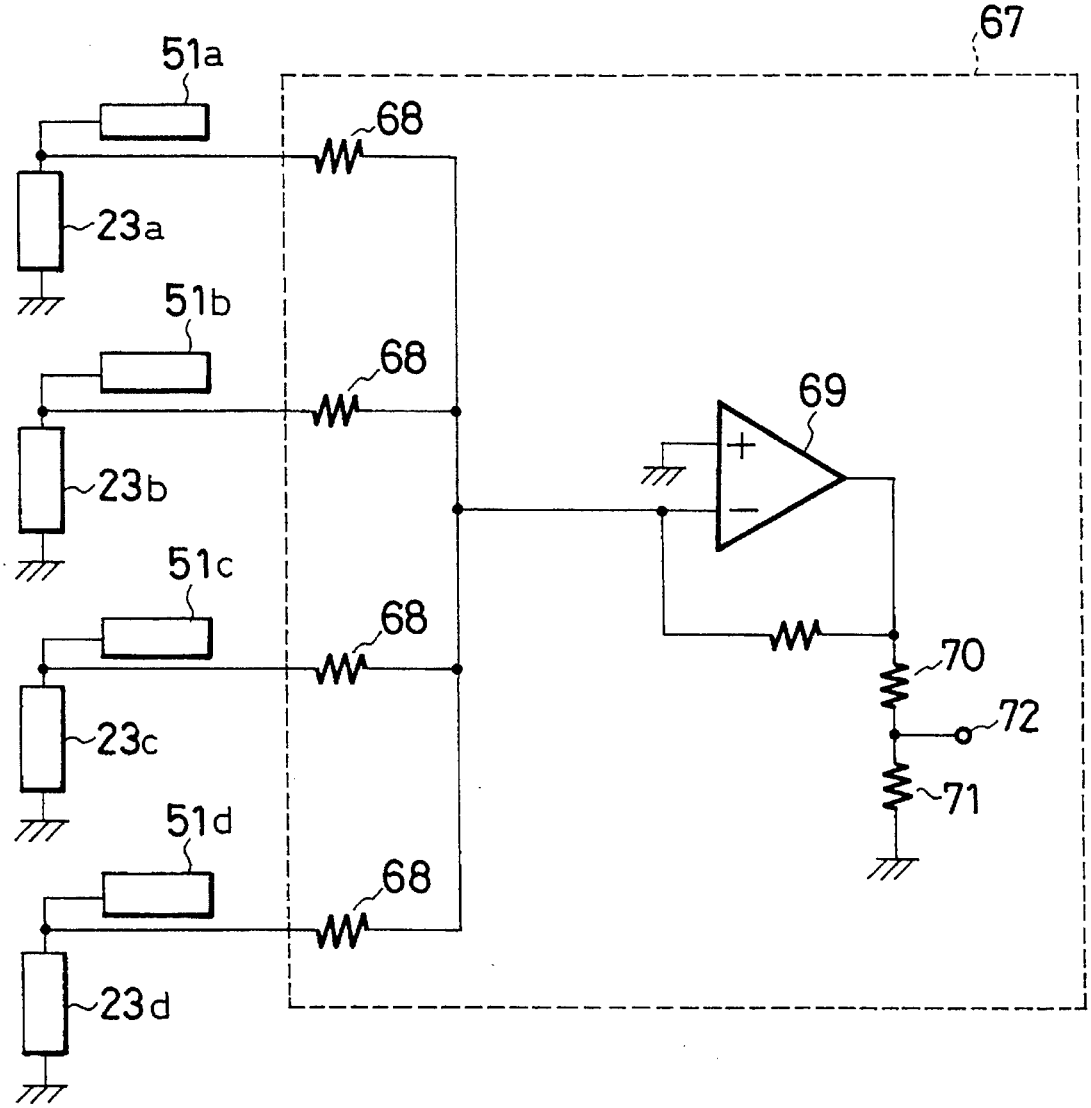
FIG. 27 is a schematic diagram of an averaging circuit for measuring the average temperature of the permanent rod magnets in the invented focusing system.

Instead of measuring the temperature of just one of the permanent rod magnets 31, it is also possible to measure the temperatures of two or more of the permanent rod magnets 31 and take their average. FIG. 27 shows a circuit for measuring the temperature of all four permanent rod magnets 31, comprising four temperature sensors 23*a*, 23*b*, 23*c*, and 23*d*, one mounted in contact with each of the permanent rod magnets 31, four constant-current sources 51*a*, 51*b*, 51*c*, and 51*d*, and an averaging circuit 67. In the averaging circuit 67, the outputs of temperature sensors 23*a*, 23*b*, 23*c*, and 23*d* are fed through four identical resistors 68 to one input terminal of an operational amplifier 69, the other input terminal of which is coupled to ground. The output of operational amplifier 69 represents the sum of the outputs off the four temperature sensors 23*a*, 23*b*, 23*c*, and 23*d*. A voltage divider comprising resistors 70 and 71 divides the output of the operational amplifier 69 so that one-fourth the sum of the outputs of the temperature sensors 23*a*, 23*b*, 23*c*, and 23*d* is obtained at a terminal 72, which is coupled to the logarithmic converter 53 in FIG. 25. This circuit can provide a more accurate measurement of the temperature of the four permanent rod magnets 31, since the temperature is measured at four points.

Instead of mounting one or more temperature sensors 23 in contact with the permanent rod magnets 31, it is possible to place the temperature sensors 23 in contact with the pole pieces 32*a* and 32*b*. Being metallic, the pole pieces 32*a* and 32*b* have good thermal conductivity, so measuring their temperature can also give an accurate indication of the temperature of the permanent rod magnets 31.

The invention is not limited to the above embodiments, but permits further variations. For example, the partition 37 of the third embodiment shown in FIGS. 19A and 19B may be a printed circuit board similar to the printed circuit board 46 in FIGS. 23A and 23B, with a temperature sensor and connector.

The permanent rod magnets 31 need not be made from manganese-aluminum powder; other magnetic materials with similar properties may be used. Furthermore, the rod magnets 31 need not be cylindrical; they may have, for example, the shapes of elongated prisms with rounded corners. Cylindrical magnets are preferred, however, because they can more easily be fabricated with a uniform composition, and use of cylindrical magnets simplifies the dimensioning of the pole pieces 32*a* and 32*b* and other parts.

Figure 1A:
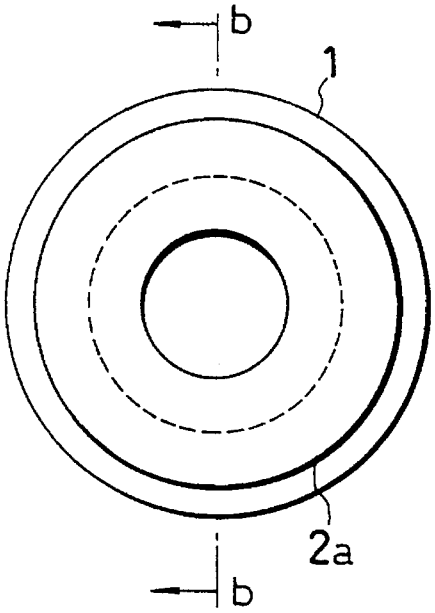
FIG. 1A PRIOR ART
FIG. 1A is a frontal view of a conventional focusing system employing a permanent ring magnet.
Figure 1B:
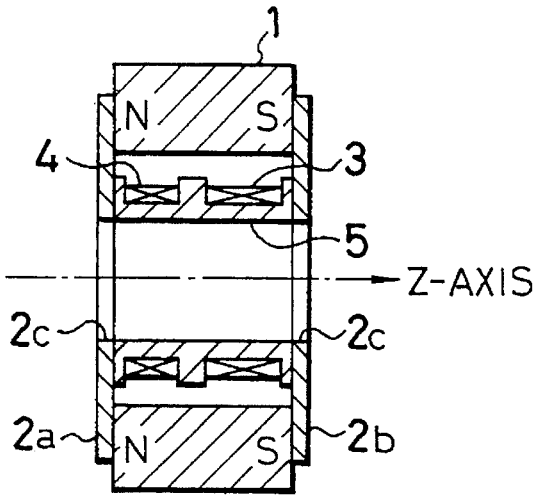
FIG. 1B PRIOR ART
FIG. 1B is a sectional side view of the focusing system in FIG. 1A.
Figure 2:
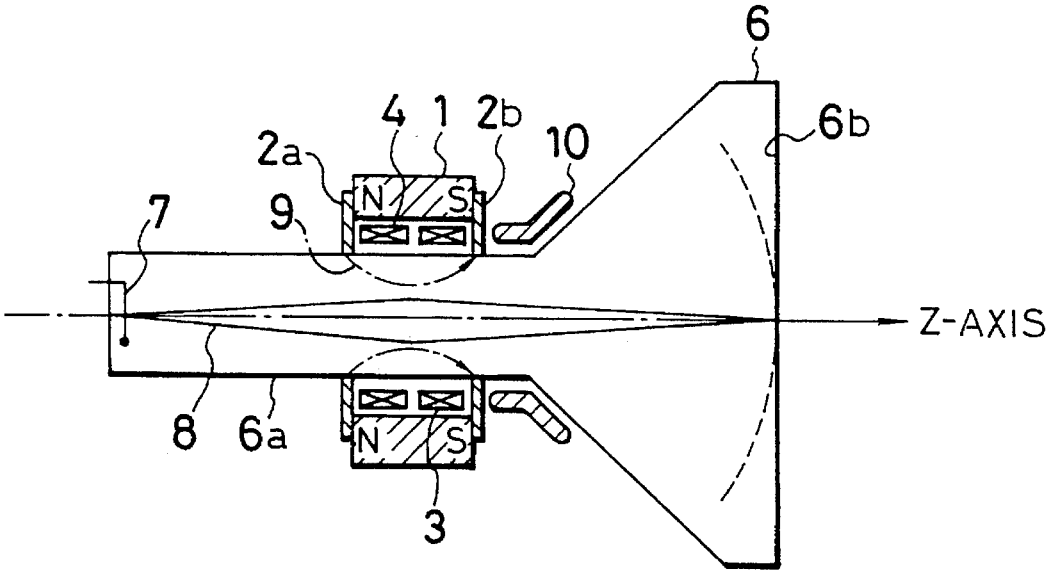
FIG. 2 depicts the operation of a magnetic focusing system for focusing an electron beam in a CRT.
Figure 3:
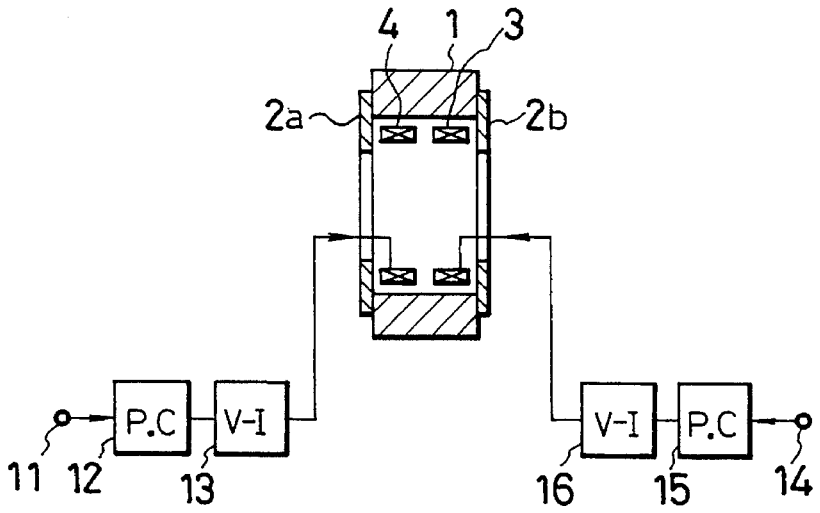
FIG. 3 illustrates dynamic focusing circuits.
Figure 4:
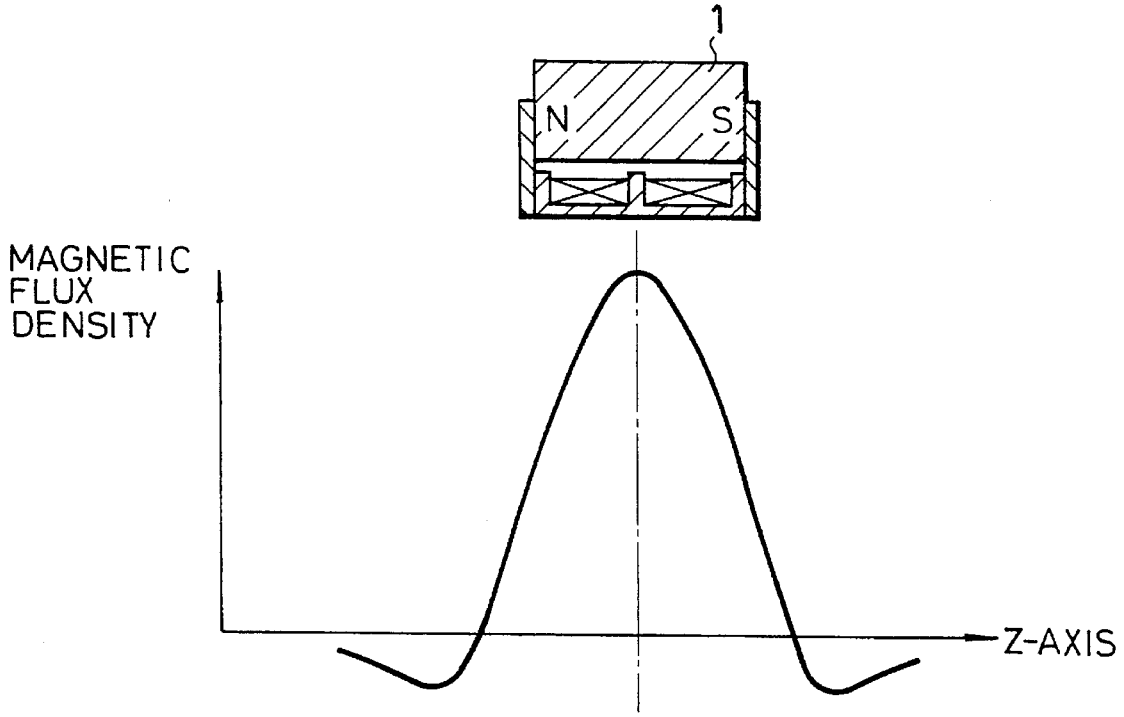
FIG. 4 illustrates the flux density distribution of a magnetic lens.
Figure 5:
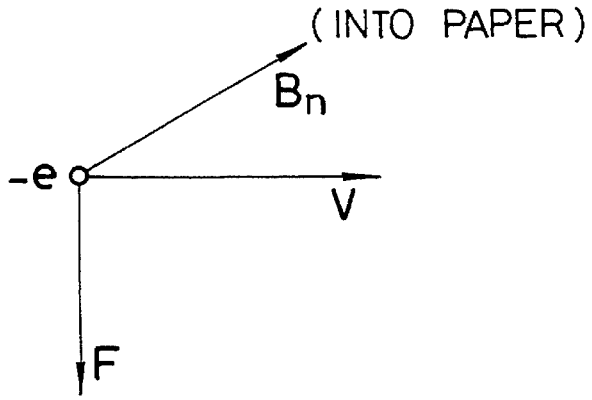
FIG. 5 illustrates the force acting on an electron in a magnetic field.
Figure 6:
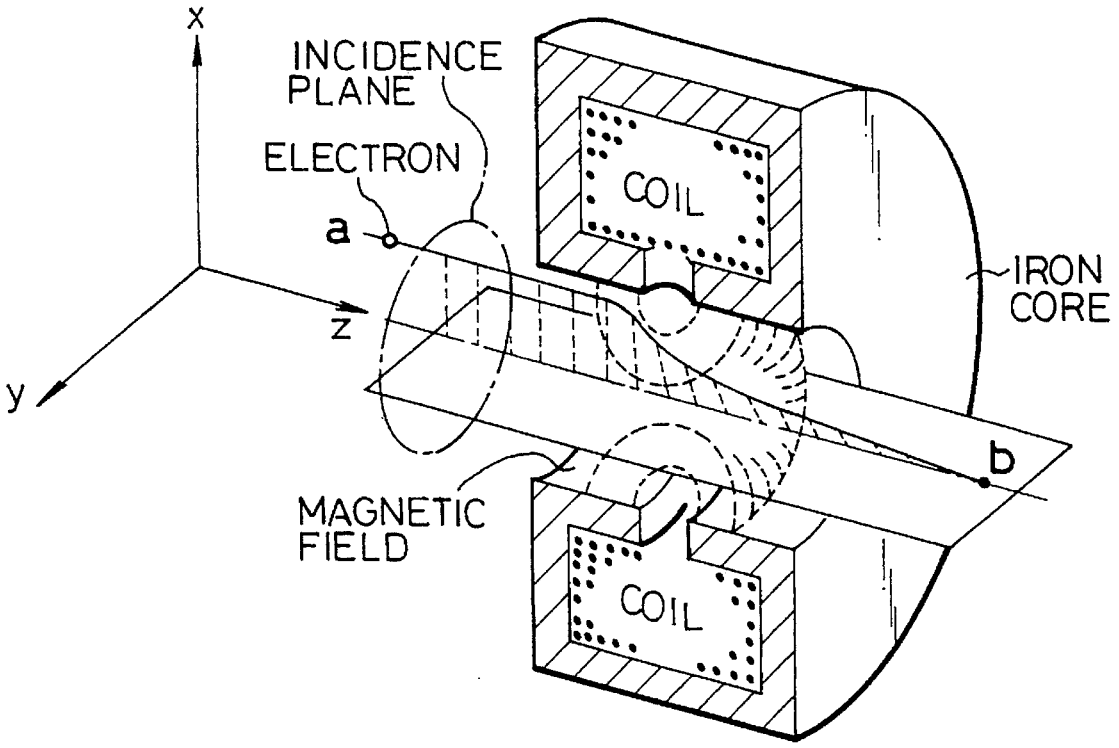
FIG. 6 illustrates the trajectory of an electron in a magnetic lens.
Figure 7:
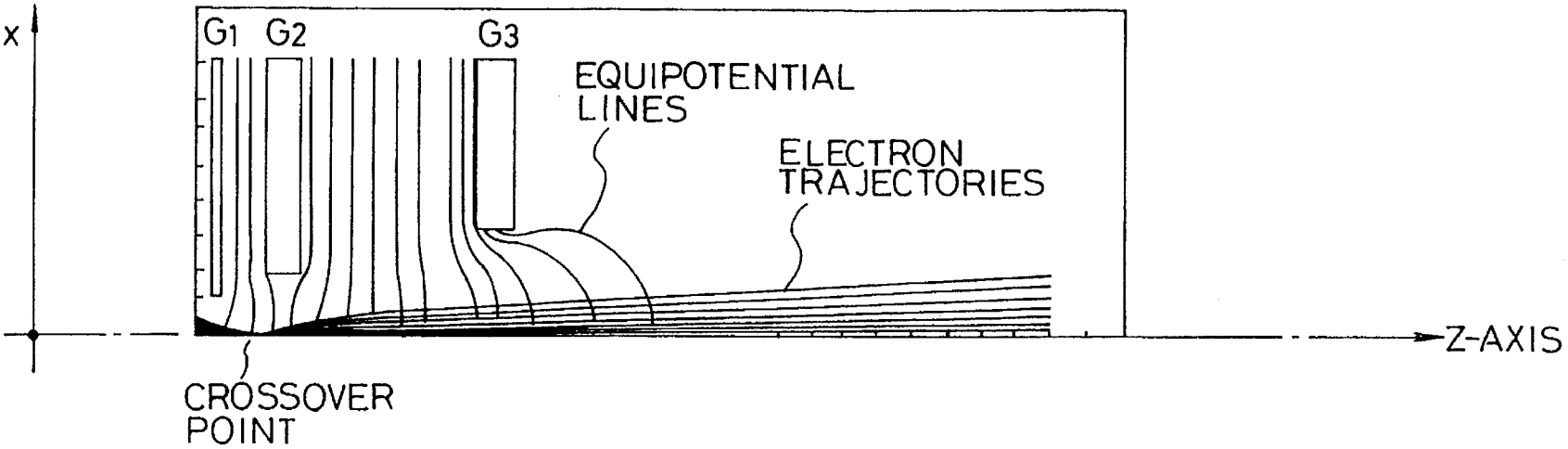
FIG. 7 illustrates the electron gun of a CRT.
Figure 8A:
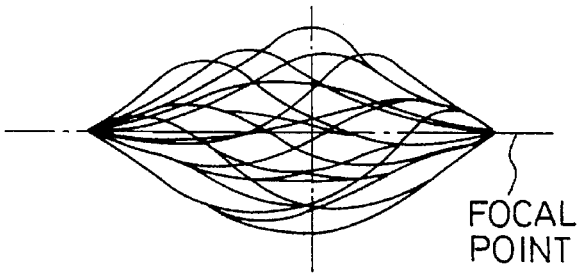
FIG. 8A illustrates electron trajectories in an ideal magnetic lens.
Figure 8B:
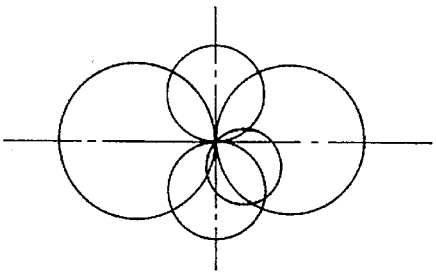
FIG. 8B shows the trajectories in FIG. 8A as seen from the focal point.
Figure 8C:
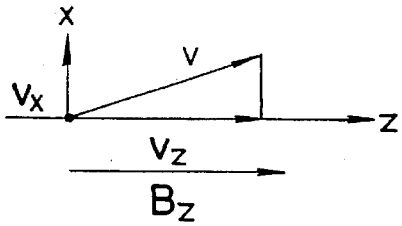
FIG. 8C illustrates velocity components of an electron in an ideal magnetic lens.
Figure 8D:
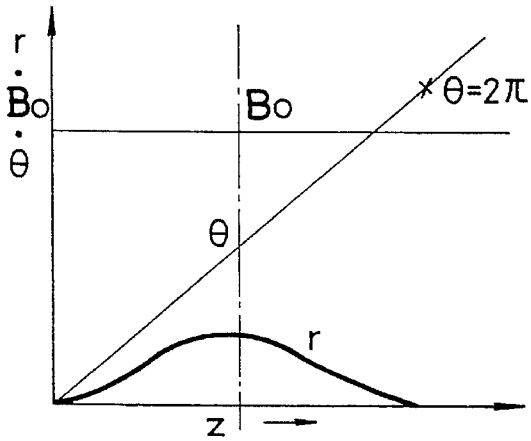
FIG. 8D illustrates the motion depicted in FIG. 8B graphically.
Figure 9A:
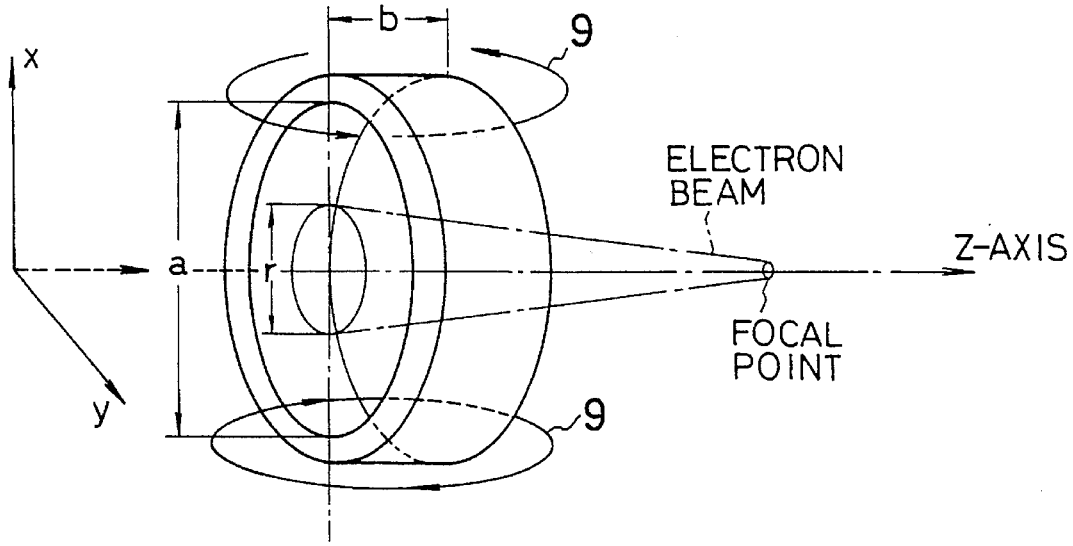
FIG. 9A illustrates parameters affecting the aberration of a magnetic lens.
Figure 9B:
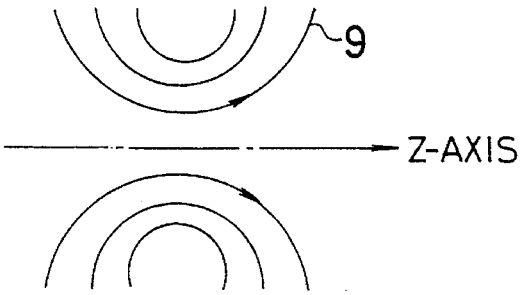
FIG. 9B illustrates magnetic flux lines in a magnetic lens.
Figure 9C:
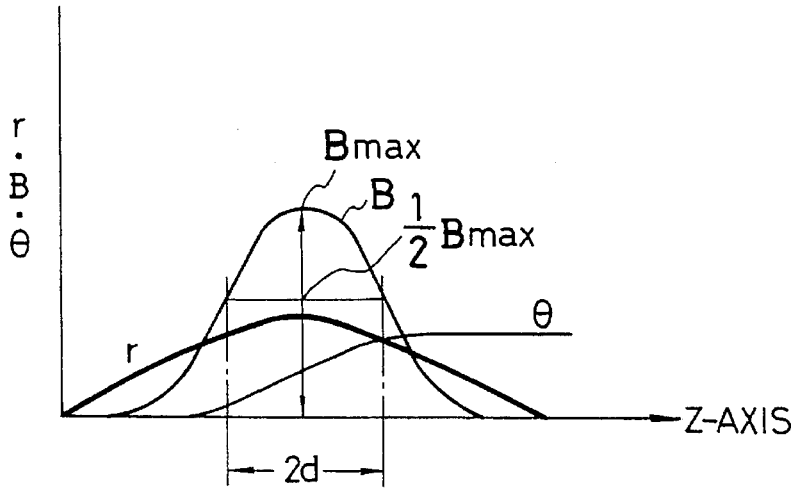
FIG. 9C illustrates the motion of electrons in the magnetic lens of FIG. 9B graphically.
Figure 10A:
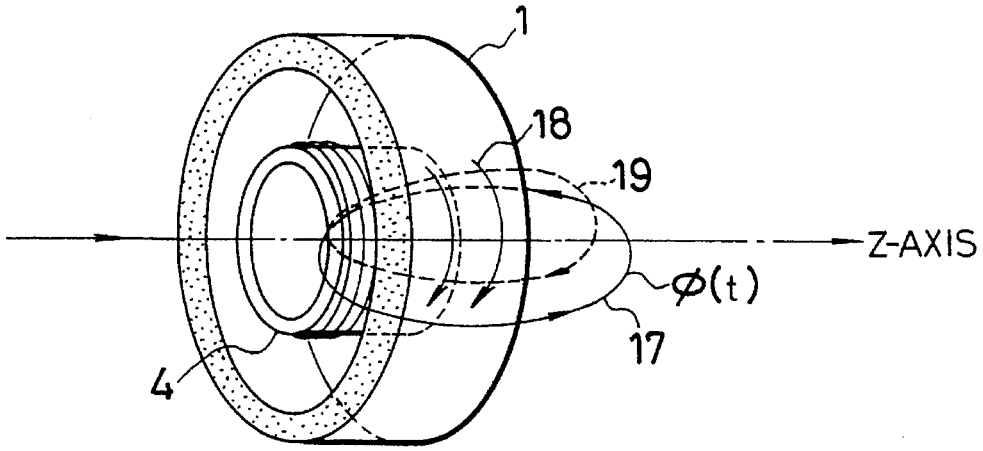
FIG. 10A PRIOR ART
FIG. 10A illustrates eddy currents induced by dynamic focusing in a permanent ring magnet.
Figure 10B:
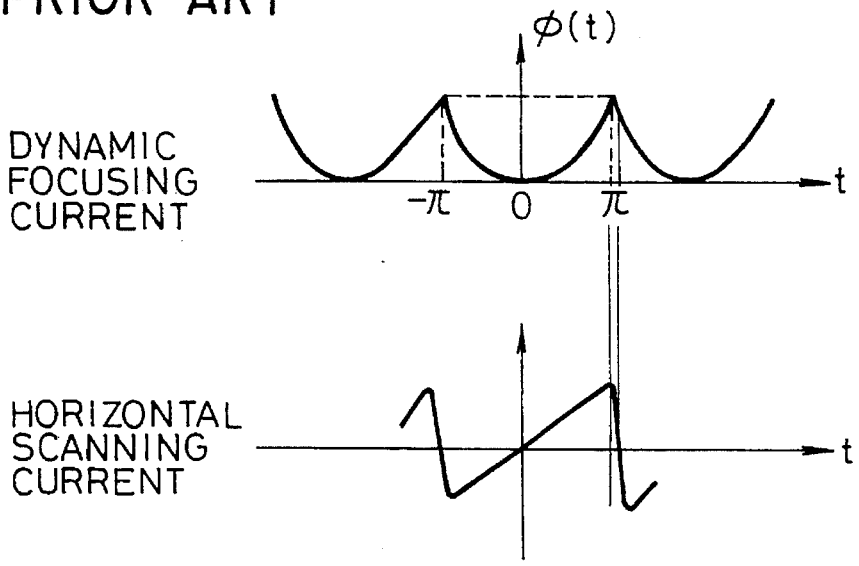
FIG. 10B PRIOR ART
FIG. 10B illustrates dynamic focusing and horizontal scanning waveforms.
Figure 11:
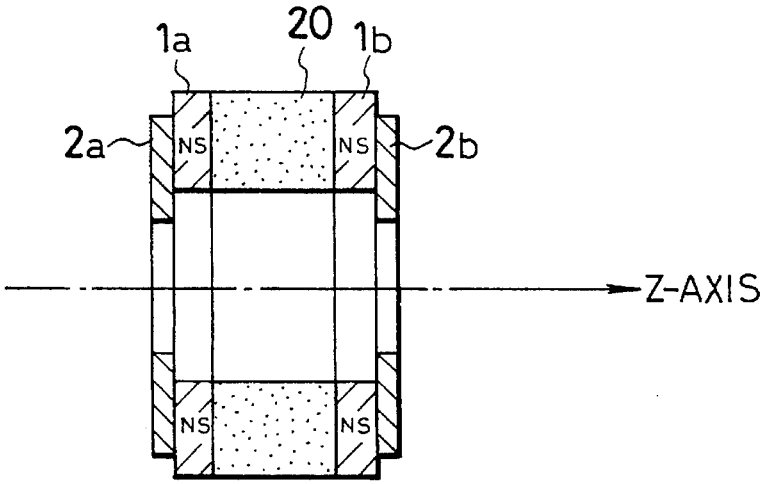
FIG. 11 PRIOR ART
FIG. 11 illustrates a conventional focusing system having two permanent ring magnets joined by an iron center yoke.
Figure 12:
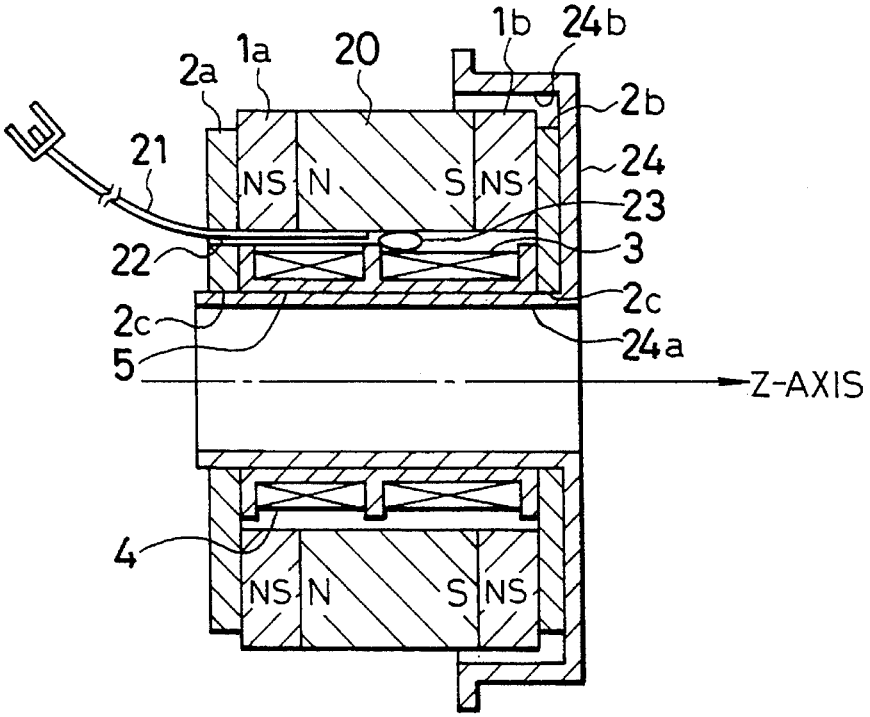
FIG. 12 PRIOR ART
FIG. 12 illustrates a variation of the conventional focusing system in FIG. 11.

The invention can be applied in hybrid focusing systems as well as in purely magnetic focusing systems. In a hybrid system, the invented magnetic focusing system replaces the electromagnet shown in FIG. 6.

Applications of the invention are not restricted to CRT focusing systems. The invention can also be applied in other types of apparatus requiring a focused electron beam, such as magnetron apparatus.

What is claimed is:

1. A magnetic focusing system for focusing an electron beam, comprising:

a pair of pole pieces having central holes and outer perimeters;

a plurality of permanent rod magnets having respective north-pole ends and south-pole ends, said north-pole ends being disposed in contact with one of said pole pieces at equally-spaced-points around its outer perimeter, said south-pole ends being disposed in contact with another of said pole pieces at equally spaced points around its outer perimeter, and said permanent rod magnets being separated so as not to make mutual contact with one another;

a hollow bobbin means for supporting at least one coil and having ends disposed in contact with said pole pieces and concentric with said central holes of said pair of pole pieces; and a dynamic focusing coil wound around said hollow bobbin means.

2. The system of claim 1, wherein said permanent rod magnets are sintered.

3. The system of claim 2, wherein said permanent rod magnets are made from manganese-aluminum powder.

4. The system of claim 1, wherein said permanent rod magnets are cylindrical in shape with circular cross sections.

5. The system of claim 1, wherein said plurality of permanent rod magnets are four permanent rod magnets.

6. The system of claim 1, wherein said plurality of permanent rod magnets are three permanent rod magnets.

7. The system of claim 1, wherein said pole pieces have semicircular projections at equally-spaced points on their outer perimeters and said permanent rod magnets are disposed in contact with said projections.

8. The system of claim 1, comprising at least one correcting coil to which a direct current is applied for magnetic flux density adjustment.

9. The system of claim 8 further comprising:

a correcting circuit for feeding said direct current to said correcting coil, said correcting circuit including, at least one temperature sensor for sensing surface temperature of one of said permanent rod magnets and producing an output signal, a logarithmic converter coupled to perform a logarithmic conversion on said output signal, thereby producing a converted output signal, and a driver coupled to feed current to said correcting coil responsive to said converted output signal.

10. The system of claim 9, wherein said correcting circuit includes, at least two temperature sensors for sensing surface temperature of at least two of said permanent rod magnets and producing respective output signals, and an averaging circuit coupled to obtain an average value of said respective output signals and supply said average value to said logarithmic converter for logarithmic conversion.

11. The system of claim 8, wherein a correcting coil is would around each of said plurality of permanent rod magnets.

12. The system of claim 1, wherein a neck of a cathode-ray tube is inserted through said central holes in said pole pieces, permitting an electron beam generated in said cathode-ray tube to be focused.

13. The system of claim 12, wherein:

said cathode-ray tube has a deflection yoke that deflects said electron beam so as to carry out vertical scanning and horizontal scanning; and an alternating current synchronized to said horizontal scanning is applied to said dynamic focusing coil for dynamic focusing.

14. The system of claim 8, wherein said dynamic focusing coil is wound around a first portion of said hollow bobbin means and said correcting coil is wound around a second portion of said hollow bobbin means.

15. They system of claim 14, further comprising a partition disposed around a periphery of said hollow bobbin means and between said dynamic focusing coil and said correcting coil.

16. The system of claim 15, wherein said partition supports said plurality of permanent rod magnets.

17. The system of claim 15, wherein said partition is a disc surrounding a central portion of said bobbin, said disc having a plurality of peripheral indentations each of which fits against a respective one of said plurality of permanent rod magnets for holding said plurality of permanent rod magnets in position.

18. The system of claim 1, further comprising:

a flanged tube having a tube extending through said central holes in said pole pieces and a flange extending outward from one end of said tube at right angles to said tube; and an alignment board having a central hole through which said tube of said flanged tube is inserted and a plurality of holes through which said permanent rod magnets are inserted.

19. A system of claim 18, wherein said alignment board has a plurality of collared hollow jackets inserted in said plurality of holes, and said plurality of permanent rod magnets are inserted in said collared hollow jackets.

20. A system of claim 19, wherein said plurality of collared hollow jackets are fixed to said alignment board by fasteners.

21. A system of claim 18, further comprising:

at least one correcting coil to which a direct current is applied for magnetic flux adjustment; and wherein said hollow bobbin means includes, a first bobbin on which said correcting coil is wound, said first bobbin being disposed between said alignment board and said one of said pole pieces, and having a central opening through which said tube of said flanged tube is inserted, and a second bobbin on which said dynamic focusing coil is wound, said second bobbin being disposed between said alignment board and said another one of said pole pieces, and having a central opening through which said tube of said flanged tube is inserted.

22. The system of claim 21, wherein said alignment board is a printed circuit board that is electrically coupled to said correcting coil and said dynamic focusing coil, said alignment board further including a connector mounted thereon for electrically coupling said alignment board to external circuitry.

23. The system of claim 21, further comprising:

a flanged tube having a tube extending through said central holes in said pole pieces and a flange extending outward from a central portion of said tube at right angles to said tube, said flange having a plurality of tubular magnet-holders through which said permanent rod magnets are inserted.

24. A system of claim 23, further comprising:

at least one correcting coil to which a direct current is applied for magnetic flux adjustment; and wherein said hollow bobbin means includes, a first bobbin on which said correcting coil is wound, said first bobbin being disposed between said flanged tube and one of said pole pieces, and having a central opening through which said tube of said flanged tube is inserted;

a second bobbin on which said dynamic focusing coil is wound, said second bobbin being disposed between said flanged tube and another one of said pole pieces, and having a central opening through which said tube of said flanged tube is inserted.

25. The system of claim 24, further comprising:

a printed circuit board with a central hole through which said tube is inserted, said printed circuit board being electrically coupled to at least one of said correcting coil and said dynamic focusing coil; and a connector mounted on said printed circuit board for electrically coupling said printed circuit board to external circuitry.

26. A magnetic focusing system for focusing an electron beam, comprising:

a pair of pole pieces having central holes and outer perimeters;

a plurality of permanent rod magnets having respective north-pole ends and south-pole ends, said north-pole ends being disposed in contact with one of said pole pieces at equally-spaced-points around its outer perimeter, said south-pole ends being disposed in contact with another of said pole pieces at equally spaced points around its outer perimeter, and said permanent rod magnets being separated so as not to make mutual contact with one another; and a correcting coil wound around each of said plurality of permanent rod magnets.

27. A magnetic focusing system for focusing an electron beam, comprising:

a pair of pole pieces having central holes and outer perimeters;

a plurality of permanent rod magnets having respective north-pole ends and south-pole ends, said north-pole ends being disposed in contact with one of said pole pieces at equally-spaced-points around its outer perimeter, said south-pole ends being disposed in contact with another of said pole pieces at equally spaced points around its outer perimeter, and said permanent rod magnets being separated so as not to make mutual contact with one another;

at least one correcting coil to which a direct current is applied for magnetic flux adjustment;

a correcting circuit for feeding said direct current to said correcting coil, said correcting circuit including, at least one temperature sensor for sensing surface temperature of one of said permanent rod magnets and producing an output signal, and a driver coupled to feed current to said correcting coil responsive to output of said temperature sensor.

28. The system of claim 27, wherein said correcting circuit includes, at least two temperature sensors for sensing surface temperature of at least two of said permanent rod magnets and producing respective output signals, and an averaging circuit coupled to obtain an average value of said respective output signals; and wherein said driver feeds current to said correcting coil based on said average value.

29. A magnetic focusing system for focusing an electron beam, comprising:

a pair of pole pieces having central holes and outer perimeters;

a plurality of permanent rod magnets having respective north-pole ends and south-pole ends, said north-pole ends being disposed in contact with one of said pole pieces at equally-spaced-points around its outer perimeter, said south-pole ends being disposed in contact with another of said pole pieces at equally spaced points around its outer perimeter, and said permanent rod magnets being separated so as not to make mutual contact with one another;

a flanged tube having a tube extending through said central holes in said pole pieces and a flange extending outward from one end of said tube at right angles to said tube; and an alignment board having a central hole through which said tube of said flanged tube is inserted and a plurality of holes through which said permanent rod magnets are inserted.

30. A system of claim 29, further comprising:

hollow bobbin means for supporting at least one coil and having ends disposed in contact with said pole pieces and concentric with said central holes of said pair of pole pieces;

a dynamic focusing coil wound around said hollow bobbin means;

at least one correcting coil to which a direct current is applied for magnetic flux adjustment; and wherein said hollow bobbin means includes, a first bobbin on which said correcting coil is wound, said first bobbin being disposed between said alignment board and said one of said pole pieces, and having a central opening through which said tube of said flanged tube is inserted, and a second bobbin on which said dynamic focusing coil is wound, said second bobbin being disposed between said alignment board and said another one of said pole pieces, and having a central opening through which said tube of said flanged tube is inserted.

31. A magnetic focusing system for focusing an electron beam, comprising:

a pair of pole pieces having central holes and outer perimeters;

a plurality of permanent rod magnets having respective north-pole ends and south-pole ends, said north-pole ends being disposed in contact with one of said pole pieces at equally-spaced-points around its outer perimeter, said south-pole ends being disposed in contact with another of said pole pieces at equally spaced points around its outer perimeter, and said permanent rod magnets being separated so as not to make mutual contact with one another; and a flanged tube having a tube extending through said central holes in said pole pieces and a flange extending outward from a central portion of said tube at right angles to said tube, said flange having a plurality of tubular magnet-holders through which said permanent rod magnets are inserted.

32. A system of claim 31, further comprising: hollow bobbin means for supporting at least one coil and having ends disposed in contact with said pole pieces and concentric with said central holes of said pair of pole pieces;

a dynamic focusing coil wound around said hollow bobbin means;

at least one correcting coil to which a direct current is applied for magnetic flux adjustment; and wherein said hollow bobbin means includes, a first bobbin on which said correcting coil is wound, said first bobbin being disposed between said flanged tube and one of said pole pieces, and having a central opening through which said tube of said flanged tube is inserted;

a second bobbin on which said dynamic focusing coil is wound, said second bobbin being disposed between said flanged tube and another one of said pole pieces, and having a central opening through which said tube of said flanged tube is inserted.

* * * * *